US011441400B2

(12) United States Patent
Blood et al.

(10) Patent No.: US 11,441,400 B2
(45) Date of Patent: Sep. 13, 2022

(54) APPARATUS AND METHODS FOR IMPROVING OIL AND GAS PRODUCTION

(71) Applicant: RUNNIT CNC Shop, Inc., Grand Junction, CO (US)

(72) Inventors: Andrew Blood, Grand Junction, CO (US); James Cole, Grand Junction, CO (US)

(73) Assignee: RUNNIT CNC Shop, Inc., Grand Junction, CO (US)

( * ) Notice: Subject to any disclaimer, the term of this patent is extended or adjusted under 35 U.S.C. 154(b) by 0 days.

(21) Appl. No.: 16/720,198

(22) Filed: Dec. 19, 2019

(65) Prior Publication Data

US 2020/0199985 A1 Jun. 25, 2020

Related U.S. Application Data

(60) Provisional application No. 62/782,154, filed on Dec. 19, 2018.

(51) Int. Cl.
*E21B 43/12* (2006.01)
*E21B 34/08* (2006.01)

(52) U.S. Cl.
CPC ..... *E21B 43/121* (2013.01); *E21B 34/08* (2013.01); *E21B 2200/04* (2020.05)

(58) Field of Classification Search
CPC ..... E21B 43/121; E21B 34/08; E21B 2200/04
See application file for complete search history.

(56) References Cited

U.S. PATENT DOCUMENTS

| | | | | |
|---|---|---|---|---|
| 5,427,504 | A * | 6/1995 | Dinning | E21B 43/121 417/59 |
| 6,209,637 | B1 | 4/2001 | Wells | |
| 6,467,541 | B1 | 10/2002 | Wells | |
| 6,591,737 | B2 * | 7/2003 | Giacomino | E21B 43/121 417/59 |
| 7,093,652 | B2 * | 8/2006 | Gray | E21B 43/121 166/101 |
| 7,314,080 | B2 | 1/2008 | Giacomino | |
| 8,162,053 | B2 * | 4/2012 | Green | E21B 43/121 166/277 |
| 8,464,798 | B2 | 6/2013 | Nadkrynechny | |
| 8,485,263 | B2 | 7/2013 | Lembcke | |
| 8,869,902 | B2 * | 10/2014 | Smith | F04B 47/12 166/383 |
| 9,121,269 | B2 * | 9/2015 | Longfellow | E21B 43/121 |
| 9,624,996 | B2 | 4/2017 | Boyd et al. | |

(Continued)

OTHER PUBLICATIONS

International Search Report from related PCT/US2019/067586, dated Jun. 15, 2020. 6 pages.

(Continued)

*Primary Examiner* — Michael R Wills, III
(74) *Attorney, Agent, or Firm* — FisherBroyles, LLP; Craig W. Mueller

(57) ABSTRACT

Provided are systems and apparatus for improving the production of hydrocarbons from a liquid loaded well. More specifically, plungers for pushing a slug of liquid up a production tubing string of an underperforming well are provided. The contemplated plungers employ pads, shifting rods, or unique outer profiles. In addition, bumper spring assemblies for arresting the downward motion of a plunger are provided.

8 Claims, 18 Drawing Sheets

(56) References Cited

U.S. PATENT DOCUMENTS

| | | | | |
|---|---|---|---|---|
| 9,863,209 | B2 | 1/2018 | Strickland | |
| 9,932,805 | B2 | 4/2018 | Kuykendall et al. | |
| 9,951,591 | B2 | 4/2018 | Boyd | |
| 10,577,902 | B2 * | 3/2020 | Townsend | E21B 43/121 |
| 2003/0155129 | A1 | 8/2003 | Gray et al. | |
| 2005/0056416 | A1 * | 3/2005 | Gray | E21B 43/121 166/68.5 |
| 2015/0053427 | A1 * | 2/2015 | Suttipisetchart | E21B 43/121 166/382 |
| 2016/0017700 | A1 | 1/2016 | Roycroft et al. | |
| 2016/0222758 | A1 | 8/2016 | Boyd et al. | |
| 2016/0237795 | A1 | 8/2016 | Xiqing et al. | |
| 2016/0312589 | A1 | 10/2016 | Decarlo | |
| 2017/0101856 | A1 * | 4/2017 | Green | E21B 43/121 |
| 2017/0107801 | A1 | 4/2017 | Townsend | |
| 2017/0191356 | A1 | 7/2017 | Steele et al. | |

OTHER PUBLICATIONS

Written Opinion from related PCT/US2019/067586, dated Jun. 15, 2020. 13 pages.

* cited by examiner

APPARATUS AND METHODS FOR IMPROVING OIL AND GAS PRODUCTION

This application claims the benefit of U.S. Provisional Patent Application Ser. No. 62/782,154, filed Dec. 19, 2018, the entirety of which is incorporated by reference therein.

FIELD OF THE INVENTION

Embodiments of the present invention are generally related to plungers and bumper spring assembly assemblies commonly used in the oil and gas industry.

BACKGROUND OF THE INVENTION

As articulated in U.S. Pat. No. 7,475,731, which is incorporated by reference herein, artificial lifting systems employ plungers to increase oil and gas well productivity. Artificial lift systems are commonly found in wells having little bottom hole pressure and, thus, are flowing below the critical flow rate, i.e., the minimum gas flow rate needed to ensure continuous removal liquids from the wellbore. That is, those of ordinary skill in the art will appreciate that productivity is adversely affected by the liquid in the well that prevents efficient transport of gases to the well surface. Indeed, liquid in the well will create enough back pressure to effectively stop gas from being produced, a phenomenon known as "loading." Accordingly, artificial lift systems that employ a plunger are used to remove liquid from the well, thereby unloading the gas.

A typical wellbore includes a number of outer casings that line its inner surface. A perforated production casing is located at the end of the outer casing(s) and is designed to receive high-pressure gas, for example, from an adjacent formation. In situations where the downhole pressure has decreased and hydrocarbon production has slowed, a production tubing string is placed in the well and is designed to primarily receive and deliver the formation gas instead of the wellbore. A well with an installed production tubing string allows formation gas to travel to the surface via the production tubing string and/or the, annulus between the outer diameter of the production tubing and the inner diameter of the casing(s). The production tubing string may be interconnected to the primary casing(s) and/or production casing with a packer. A bumper spring assembly is situated at the end of the production tubing string.

The bumper spring assembly often comprises a nipple comprising at least one seal that tightly engages with the inner diameter of the production tubing string. Most bumper spring assembly assemblies comprise a rod, and end piece (i.e., a "fish neck") at the upper end of the rod, and a cage operably attached to the lower end of the rod.

In operation, a motor valve associated with the wellhead closes to cease hydrocarbon production, i.e., "shut in" the well, which also releases a plunger from a lubricator valve located outside the well. The plunger travels down the production tubing string, through accumulated fluids, and eventually, contacts the bumper spring assembly designed to protect the production tubing string from plunger impact. Pressure within the well builds during the shut-in phase, wherein the motor valve opens after the pressure builds to a predetermined level. Opening the motor valve creates a pressure differential that allows the gas below the plunger to push it and the liquid above the plunger toward the surface. The liquids are then separated from the gas and the plunger is again captured by the lubricator spring. The well will stay in the open state until liquid loading adversely affects well pressure to a predetermined degree, which signals to the motor valve to close to begin another lift cycle.

SUMMARY OF THE INVENTION

Embodiments of the present invention are directed to plungers that employ improvements relative to those described in U.S. Pat. Nos. 6,045,335, 6,591,737, 6,669,449, and 9,932,805, and U.S. Patent Application Publication No. 2017/0107801, which are incorporated by reference herein. A general description of how plungers function can be found in U.S. Pat. No. 7,093,652, which is incorporated by reference herein.

Pad Plunger

To allow a plunger to fall after being lifted to the surface, the engagement between the plunger and the inner surface of the production tubing string cannot be extreme as fictional interactions will adversely affect plunger movement. At the same time, the engagement must be able to promote a sufficient pressure differential to provide the necessary force to lift to the plunger. A typical pad plunger is described in U.S. Patent Application Publication No. 2017/0107801. U.S. Pat. Nos. 8,869,902 and 7,448,442 also describe plungers with wear pads. In these latter examples, downhole pressure enters behind the wear pads to bias them outwards to improve the plunger seal.

It is one aspect of some embodiments of the present invention to provide a pad plunger comprising a mandrel with pad-receiving profiles defined by a first circumferential recess positioned toward a downhole end of the mandrel and a second circumferential recess positioned toward a surface end of the mandrel. A plurality of selectively-deployable pads are located at the first circumferential recess and at the second circumferential recess. The plurality of pads are capable of limited radial movement so as to contact an inner surface of the production tubing string during plunger assent. Spring members are positioned between the circumferential recesses and the plurality of pads. The spring members are designed to bias the pads outwardly.

It is one aspect of some embodiments of the present invention to provide a segmented sleeve plunger that has advantages over similar devices and apparatus of the prior art. More specifically, the plunger of one embodiment is comprised of a mandrel that selectively receives and maintains a plurality of segmented sleeves, comprised of a plurality of interlocking pads. The pads help radially locate the plunger within the production tubing string and prevent fluid migration between extended pads and the mandrel.

Current designs employ locating features that generally coincide with a normal axis of each pad, i.e., along a radial direction of the mandrel, to maintain alignment of the pads as they move away from and towards the mandrel. Often, alignment is accomplished with tabs in the pads that engage recesses in the mandrel or slots in the pads that engage pins or protrusions extending from the mandrel. Often, a pair of locating features are near the pad ends. Embodiments of the present invention employ a single locating pin or post located near the center of the pad that engages a slot, for example, in the mandrel. This feature allows for an unbroken and uniform sealing surface at both ends of the pad, which helps maintain the desired pressure differential as the plunger is forced upwardly in the production tubing string.

Current designs use a variety of methods to prevent fluid and/or gas migration around each pad, which adversely affects the plunger's ability to pull material from the production tubing string. For example, plungers often employ a "turbulent seal" or a "labyrinth seal" created by a close tolerance fit between interlocking features on the pads and mandrel. Because the features that create the turbulent seal do not contact each other, the seal is imperfect and will allow some degree of leakage, which is sometimes addressed by providing a rubber seal between the mandrel in the pads.

Embodiments of the present invention address this issue by providing a mechanical seal at each pad end. Depending on the direction of travel, one plunger end of will provide a mechanical seal and the opposite end will take advantage of a close tolerance fit to provide a secondary labyrinth seal. To further enhance this embodiment's sealing capabilities, and to reduce the amount of fluid and/or gas that enters into an annulus defined by the extended pads in the mandrel, the contemplated pads may interlock to provide a gapless seal.

The contemplated gapless seal is formed by interlocking features of each pad's longitudinal sidewalls defined by an outer portion offset from an inner portion. The end profile of each pad is comprised of an outer arcuate member interconnected to an inner arcuate member, wherein the radius of curvature center points of the inner and outer members do not coincide. This feature allows the pads to collapse to fit inside a "drift diameter" provided by the mandrel but substantially allows for complete radial contact with the inside diameter of the well tubing.

Shifting Rod Plunger

It is an aspect of some embodiments of the present invention to provide a plunger generally comprised of a rod that operatively supports a movable body. The rod comprises an upper end and a lower end, i.e., a head, configured to contact a bumper spring assembly located at the end of the production tubing string. The rod is received within the hollow body, which is configured to move from a first position of use near the upper end and the second position of use wherein a portion of the head is captured by the body. The body includes at least one bypass orifice that allows fluid and/or gas to pass through the hollow body's bore and out of the plunger during the descent through the production tubing string towards the bumper spring assembly. Contact with the bumper spring assembly shifts the body downwardly to engage a portion of the head within the bore, thereby blocking the bypass orifice, which allows the plunger to be urged upwardly and carry liquid to the well surface. A typical shifting rod plunger is described in U.S. Pat. No. 7,314,080, which is incorporated by reference herein.

It is another aspect of this embodiment of the present invention to provide a rod that maintains its radial position within the body. More specifically, the rod of one embodiment includes a plurality of radially extending protrusions that operatively engage the inner surface of the bore. The protrusions centralize the rod within the body and, thus, limit radial displacement of the rod when in the open configuration, i.e., when the plunger is falling through the production tubing string. More importantly, the protrusions reduce radial rod displacement when the body transitions from the open position of use to a closed position of use and vice versa. Those of ordinary skill in the art will appreciate that existing rods can be off-center when the bumper spring assembly or the lubricator spring is impacted. Stabilizing the rod as contemplated by this embodiment of the present invention reduces "whipping" of the rod within the body and subsequent breakage at the rod ends.

Embodiments of the present invention also employed and enhanced connection between the end and the rod that reduces the effects of repeated impacts of the body onto the end. More specifically, the end, which is often referred to as a "fish neck," is threaded onto the end of the rod opposite the head. An unthreaded portion of the fish neck engages the corresponding smooth portion of the rod in a close tolerance relationship. Accordingly, impact loads are transmitted from the fish neck to the rod at this location directly from the smooth surface of the counterbore to that of the rod, instead of through threads. This feature helps reduce thread breakage at this critical location and, thus, increases plunger life. The fish neck may also have an end with a conical profile received in a complementary conical chamfer provided in the body, which cooperates with the above-mentioned protrusions to maintain radial displacement between the body and the rod where the rod impacts the lubricator spring.

Sand Plunger

Sand located the bottom of some wells can enter inner cut grooves of typical plungers, thereby adversely affecting their ability to drop and rise through the production tubing string. Plungers caked with sand, for example, often get caught within the lubricator, which will cause time-consuming and expensive maintenance to address. Indeed, a plunger caked with sand may fail to fall or fall to slowly to the bottom of the well, which could allow more fluids than desired to enter the wellbore.

As illustrated in U.S. Pat. No. 7,513,301, which is incorporated by reference herein, sand plungers commonly employ a plurality of radially-extending holes extending from outside the plunger into the plunger bore that are designed to enhance per the orifices allow for gas transfer from the well into the liquid load during plunger lift. Resulting gas jets produce by the orifices create aeration about the plunger, which allows the plunger to carry a heavier load to the well surface. This feature also allows for liquids to rise through the production tubing at a faster rate. The aeration about the plunger also creates the cleaning action, which is often desired to mitigate sand impaction. Plungers employing orifices require a center bore that communicates with intersecting orifices through the plunger side wall at a plurality of locations. Some plungers also possess an outer profile that comprises a plurality of grooves that enhance the cleaning action and assist in forming a turbulent seal that helps prevent fluid transfer around the plunger as it rises through the production tubing string.

It is one aspect of some embodiments of the present invention to eliminate the center bore and/or intersecting radial orifices traditionally used to bleed gas pressure and instead incorporate slots into the outside profile of the plunger. In one embodiment of the present invention, the outer configuration of the plunger is ridged and comprised of peaks and valleys. The slots are formed in alternate peaks at first orientations (e.g., at about 0° and 180°) and at intervening peaks at second orientations (e.g., at about 90° and 270°). The dimensions, location, number of slots can vary depending on the desired performance. The slots place alternating locations of 180° from peak to peak will enhance self-cleaning and create an improved turbulent seal. At least one of the peaks may also employ a circumferential groove, commonly at the top and bottom ridges that reduce descent times and promote aeration of the fluid column above the plunger during ascent.

Bumper Spring Assembly

As briefly mentioned above, plunger lift systems employ a bumper spring assembly that receives the plunger at or near the end of the production tubing string. A lower end of the plunger will rest on an upper end of the bumper spring assembly while the well is shut in. Once well pressure reaches a predetermined level, the motor valve is opened which forces the plunger upwardly with its slug of liquids.

For plunger lift systems to be effective, some of the very liquids that adversely affect well pressure and, thus, efficiency, need to remain in the production tubing string when the well is shut in. Commonly, the bumper spring assembly includes a standing valve installed that maintains liquid accumulations in the tubing. Standing valves are more common in wells with low bottom hole pressures, where liquids may easily and quickly flow back into the formation because of gravity segregation of the gas and liquid. It's one disadvantage of existing standing valves is that they eliminate the ability to equalize production tubing string and casing pressures.

One embodiment of the present invention addresses this issue by providing a standing valve that has pressure release capabilities. A bumper spring assembly using a standing valve with pressure relief capabilities is described, for example, in U.S. Patent application Publication No. 2016/0222758, which is incorporated by reference herein. It is one aspect of some embodiments the present invention to improve upon prior designs by eliminating an inside sleeve and flute/grooves of an outside body, i.e., manufacturing complexities.

It is a related aspect of some embodiments of the present invention to increase bumper spring assembly life cycle by improving a fish neck, i.e., the upper end, of the bumper spring assembly. In one embodiment, the fish neck includes a plurality of radially extending protrusions near the end that is threaded onto a bumper spring assembly rod, which is encircled by the bumper spring assembly. The radially extending protrusions are designed to selectively engage the internal surface of the tubing, which helps keep the bumper spring assembly aligned at plunger impact. The contact face of the fish neck, i.e., the face that receives the impact of the plunger, may have a spherical profile that matches a ball. One of ordinary skill in the art will appreciate that this aspect of some embodiments of the present invention is suited for ball/sleeve plungers.

Bumper spring assemblies often use a variety of methods to secure threaded connections which prohibits the inadvertent separation of the components that make up the ball spring assembly. Those of skill in the art will appreciate that these common methods—pressed pins, welds, set screws, and crimped or upset the formation—each has at least one drawback. Embodiments of the present invention address these issues by using a locking washer having a plurality of outwardly extending locking tabs. The contemplated locking washer is placed between threaded components wherein a locating tab engages a longitudinal slot found in the male threaded component. The slot may be formed to a depth slightly below the minor diameter of the threads. The locking tabs are aligned with at least one locking recess formed in the surface of the female threaded component. After assembly of the male and female components, at least one of the locking tabs is deformed into a corresponding locking recess, thereby preventing unintentional loosening of the assembly components. Disassembly is initiated by bending the locking tab out of its recess.

Further aspects of the present invention are provided in the following embodiments:

It is one aspect of some embodiments of the present invention to provide a plunger of an artificial lift system, comprising: a mandrel having a downhole end with a plurality of angled channels and an upper end spaced from the downhole end; a first circumferential recess adjacent to the downhole end having first radial slots evenly spaced in four locations about the circumference of the first circumferential recess, the first slots having an elongate profile generally parallel to a longitudinal axis of the mandrel, first springs integrated into the mandrel adjacent to a downhole end of each first slot, and second springs integrated into the mandrel adjacent to an upper end of each first slot; a plurality of first pads having an outer arcuate portion and an inner arcuate portion for selective positioning adjacent to and away from an outer surface of the first circumferential recess, wherein the inner arcuate portion includes a post selectively received within the first radial slots, the outer arcuate portion having lateral edges of a sinusoidal shape that generally correspond with the longitudinal axis of the mandrel, the inner arcuate portion having lateral edges that generally correspond with the longitudinal axis of the mandrel, wherein the lateral edges of the outer arcuate portion and the inner arcuate portion are offset to define a ledge and an overhang, wherein an upper surface of the ledge is configured to selectively engage a lower surface of the overhang of an adjacent first pad of the plurality thereof to form a substantially continuous seal; a second circumferential recess adjacent to the upper end having second radial slots evenly spaced in four locations about the circumference of the second circumferential recess, the second slots having an elongate profile generally parallel to the longitudinal axis of the mandrel, third springs integrated into the mandrel adjacent to a downhole end of each second slot, and fourth springs integrated into the mandrel adjacent to an upper end of each second slot; a plurality of second pads having an outer arcuate portion and an inner arcuate portion for selective positioning adjacent to and away from an outer surface of the second circumferential recess, wherein the inner arcuate portion includes a post selectively received within the second radial slots, the outer arcuate portion having lateral edges of a sinusoidal shape that generally correspond with the longitudinal axis of the mandrel, the inner arcuate portion having lateral edges that generally correspond with the longitudinal axis of the mandrel, wherein the lateral edges of the outer arcuate portion and the inner arcuate portion are offset to define a ledge and an overhang, wherein an upper surface of the ledge is configured to selectively engage a lower surface of the overhang of an adjacent second pad of the plurality thereof to form a substantially continuous seal; a ring of a first length positioned between the first circumferential recess and the second circumferential recess, the ring having an outer extent greater than that of the first circumferential recess and the second circumferential recess; a band positioned about the ring, the ring band having a second length greater than that of first length of the ring, wherein a first portion of the ring extends over the first circumferential recess and a second portion of the ring extends over the second circumferential recess; wherein the first pads have a first position of use adjacent to the outer surface of the first circumferential recess and a second position of use urged away from the outer surface of the first circumferential recess by the first and second springs and prevented from expansion past a predetermined degree by the first portion of the ring; and wherein the second pads have a first position of use adjacent to the outer surface of the second circumferential recess and a second position of use urged away from the outer surface of the second circumferential recess by the third and fourth springs and prevented from expansion past a predetermined degree by the second portion of the ring.

It is another aspect of some embodiments of the present invention to provide a plunger of an artificial lift system, comprising: a body having a bore extending from a first end and a second end thereof, the body having at least one orifice extending from an outer surface of the body into the bore; a rod configured to fit within the body, the rod having a head at one end and a threaded end spaced from the head, the rod also having a plurality of radially extending protrusions configured to operatively engage an inner surface of the bore; an end piece engaged to the threaded end of the rod; and wherein the body has a first position of use with the first end of the body is engaged to the end piece, and a second position of use wherein the body is moved towards the head such that the first end of the body is spaced from the end piece and a portion of the head is positioned within the bore adjacent to the second end of the body.

It is still yet another aspect of some embodiments to provide a bumper spring assembly of an artificial lift system, comprising: a hollow cage having a first end, a second end, and at least one opening extending into an inner volume of the cage; a rod having a first end and a second end configured to move with the cage; an end piece interconnected to the first end of the rod; a first spring positioned about the rod, the first spring abutting the end piece and the first end of the cage; a nipple subassembly interconnected to the second end of the cage and adapted to engage an inner surface of a production tubing string; and a standing valve, comprising: a spring seat positioned above the nipple subassembly and within the cage, the spring seat comprised of a disk with at least one fluid opening and a protrusion extending from the disk, a second spring resting on the spring seat, a ball seat resting on the second spring, a ball positioned within the cage and configured to selectively engage the ball seat, and wherein the ball engages the ball seat to close the standing valve when the inner volume of the cage is exposed to a first pressure, and wherein the ball disengages from the ball seat when pressure within the cage increases to a second pressure that urges the ball and ball seat against the second spring to a point where an end of the protrusion contacts the ball, thereby moving the ball out of engagement with the ball seat.

It is yet another aspect of some embodiments to provide an artificial lift system, comprising: a plunger adapted to be positioned within a production tubing string; and a bumper spring assembly, comprising: a hollow cage having a first end, a second end, and at least one opening extending into an inner volume of the cage; a rod having a first end and a second end configured to move with the cage; an end piece interconnected to the first end of the rod; a first spring positioned about the rod, the first spring abutting the end piece and the first end of the cage; a nipple subassembly interconnected to the second end of the cage and adapted to engage an inner surface of a production tubing string; and a standing valve, comprising: a spring seat positioned above the nipple subassembly and within the cage, the spring seat comprised of a disk with at least one fluid opening and a protrusion extending from the disk, a second spring resting on the spring seat, a ball seat resting on the second spring, a ball positioned within the cage and configured to selectively engage the ball seat, and wherein the ball engages the ball seat to close the standing valve when the inner volume of the cage is exposed to a first pressure, and wherein the ball disengages from the ball seat when pressure within the cage increases to a second pressure that urges the ball and ball seat against the second spring to a point where an end of the protrusion contacts the ball, thereby moving the ball out of engagement with the ball seat.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description hereinbelow.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and drawing figures are to be understood as being approximations that may be modified in all instances as required for a particular application of the novel assembly and method described herein.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and in the appended drawing figures.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
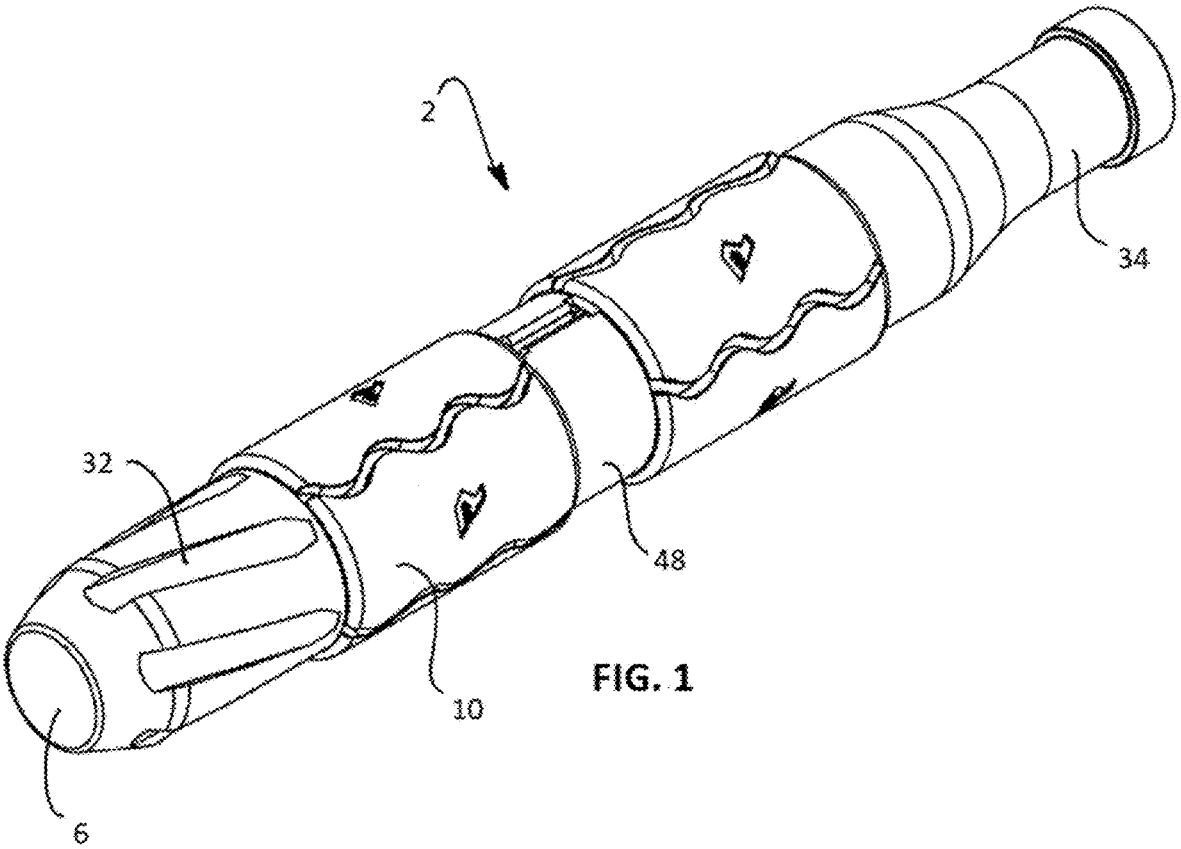
FIG. 1 is a perspective view of a pad plunger of one embodiment of the present invention.
Figure 2:
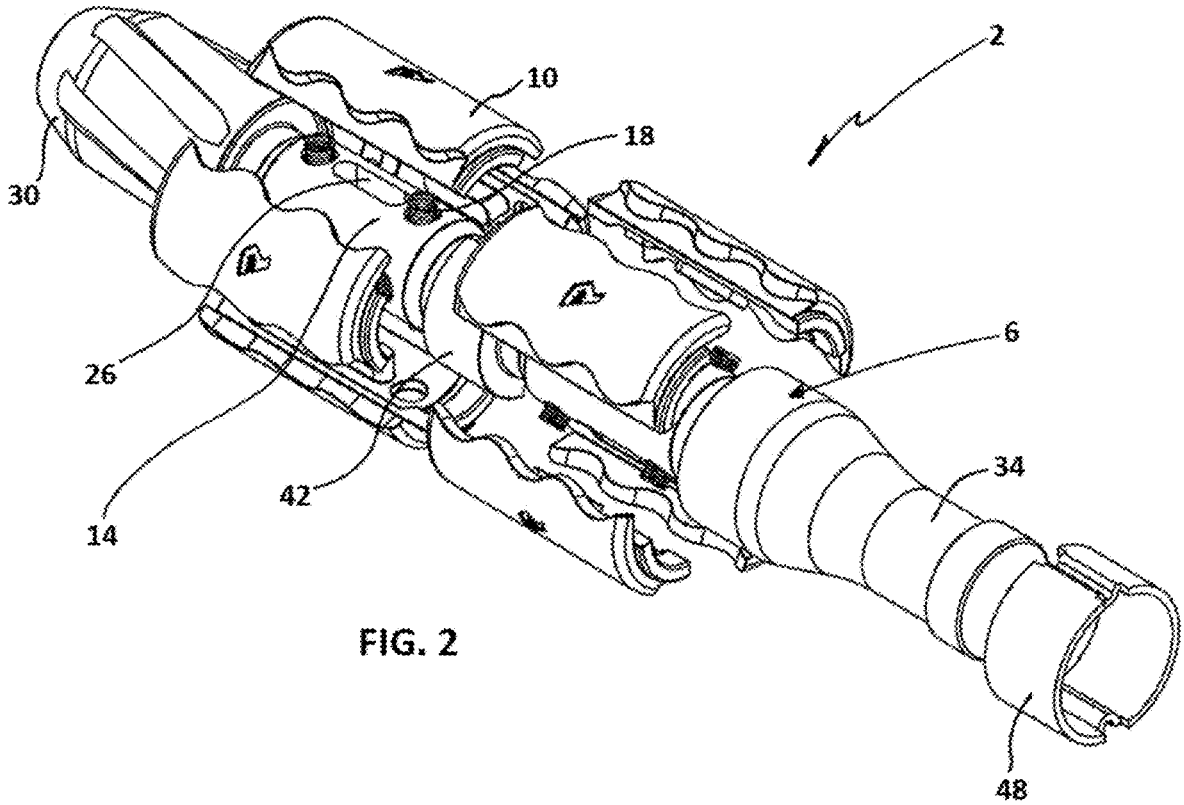
FIG. 2 is an exploded perspective view of the pad plunger shown in FIG. 1.

The following component list and associated numbering found in the drawings is provided to assist in the understanding of one embodiment of the present invention:

| # | Component |
|---|---|
| 2 | Pad plunger |
| 6 | Mandrel |
| 10 | Pad |
| 14 | Circumferential recesses |
| 18 | Spring |
| 22 | Post |
| 26 | Slot |
| 30 | Downhole end |
| 32 | Channel |
| 34 | Fish neck |
| 38 | Recess |
| 42 | Ring |
| 46 | Band |
| 48 | Finger |
| 50 | Inner portion |
| 54 | Outer portion |
| 58 | Outer surface |
| 62 | Lateral edge of the outer portion |
| 66 | Lateral edge of the inner portion |
| 70 | Ledge |
| 74 | Overhang |
| 102 | Shifting rod plunger |
| 106 | Body |
| 110 | Rod |
| 114 | Head |
| 118 | Bore |
| 122 | Ridge |
| 126 | Orifice |
| 130 | Upper end |
| 132 | Channel |
| 134 | Fish neck |
| 138 | Protrusion |
| 142 | Inner surface |
| 146 | Conical riser |
| 150 | Inner face |
| 154 | Conical bore |
| 202 | Sand plunger |
| 222 | Ridge |
| 230 | Downhole end |
| 232 | Channel |
| 234 | Fish neck |
| 250 | Slot |
| 254 | Groove |
| 302 | Bumper spring assembly |
| 306 | Cage |
| 310 | Nipple subassembly |
| 314 | Rod |
| 318 | Fish neck |
| 322 | Spring |
| 326 | Opening |
| 330 | Standing valve |
| 334 | Ball |
| 338 | Ball seat |
| 342 | Spring |
| 346 | Spring seat |
| 350 | Disk |
| 354 | Opening |
| 360 | Pin |
| 364 | Hub |
| 368 | Protrusion |
| 402 | Bumper spring assembly |
| 406 | Cage |
| 410 | Nipple subassembly |
| 414 | Rod |
| 418 | Fish neck |
| 422 | Spring |
| 426 | Opening |
| 430 | Standing valve |
| 434 | Ball |
| 438 | Ball seat |
| 442 | Adapter |
| 446 | Threaded portion |

-continued

| # | Component |
|---|---|
| 450 | Slot |
| 454 | Locking washer |
| 458 | Locating tab |
| 462 | Locking tab |
| 466 | Locking recess |

It should be understood that the drawings are not necessarily to scale. In certain instances, details that are not necessary for an understanding of the invention or that render other details difficult to perceive may have been omitted. In addition, the discussion of any dimensions is for reference only, wherein those of ordinary skill in the art will appreciate embodiments of the present invention described herein are not limited by such dimensions. It should be understood, of course, that the invention is not necessarily limited to the particular embodiments illustrated herein.

DETAILED DESCRIPTION

FIGS. 1-11 show a pad plunger 2 of one embodiment of the present invention generally comprised of a mandrel 6 with a plurality of pads 10 operatively interconnected thereto. More specifically, the pad plunger 2 employs a plurality of selectively extending and interlocking pads 10 that have a first position of use within circumferential recesses 14 provided in the mandrel 6 and the second position of use wherein the pads 10 are biased outwardly from the mandrel 6 by at least one spring 18. The pads 10 of the pad plunger 2, which may also be referred to as a "segmented sleeve plunger," expand to engage an inner surface of the production tubing string. One benefit of the embodiment of the present invention shown is that a mechanical seal is provided between portions of adjacent pads (see, FIGS. 6 and 8) regardless of its position relative to the mandrel. The mechanical seal allows for pressure to be maintained below the plunger as it ascends through the production tubing string and prevents fluid from escaping around the plunger as it rises. The pads possess at least one inwardly extending post or pin 22 (see FIG. 11), that selectively engages a hole or slot 26 provided in the mandrel 6. This operative interconnection scheme provides an unbroken and uniform sealing surface at both ends of the pad 10.

Figure 7:
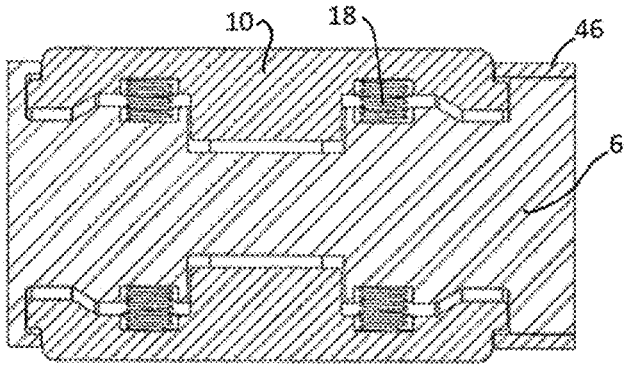
FIG. 7 is a detailed view of FIG. 4, showing the pads in a deployed state.
Figure 8:
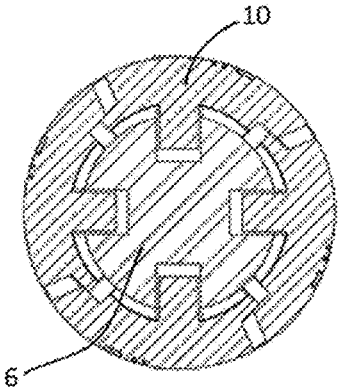
FIG. 8 is a right elevation view of FIG. 7.
Figure 9:
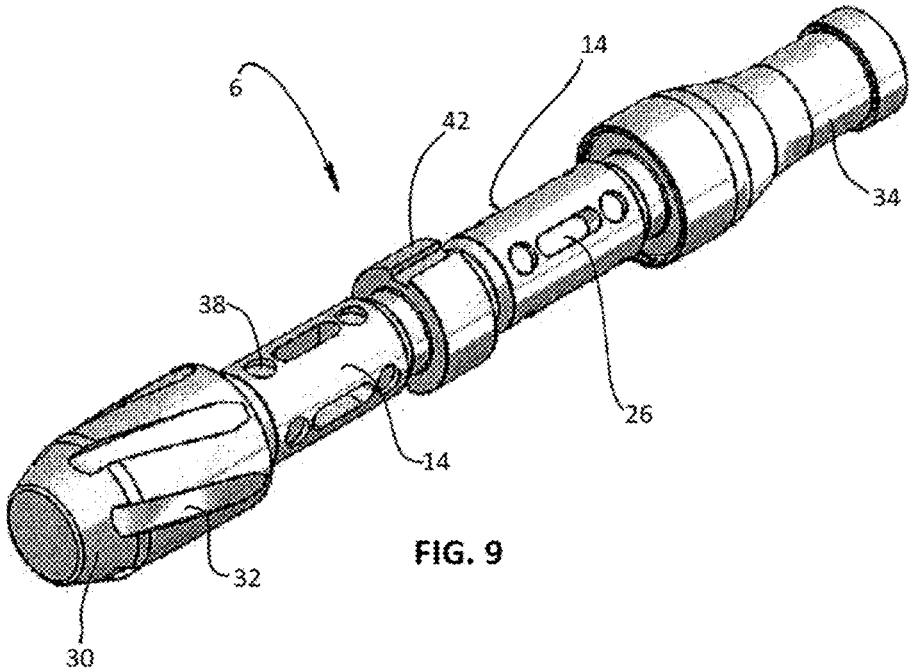
FIG. 9 is a perspective view of a mandrel employed by the embodiment shown in FIG. 1.

As one of ordinary skill in the art will appreciate, it is important to prevent or at least mitigate fluid/gas migration under the pads. Accordingly, some prior designs rely on turbulent seals or labyrinth seals formed by a close tolerance fit between the pads and the body. These types of seals are often imperfect. Again, as shown, for example, in FIGS. 6-8, embodiments of the present invention form a tight mechanical seal at both ends of each pad. Adjacent pads interlock to define a pad subassembly that provides a gapless seal between each pad regardless of position—the pads retracted to a position adjacent to the body and extended therefrom. Depending on the direction of plunger travel, one pad subassembly will provide a mechanical seal (FIGS. 5 and 6) and the other pad subassembly will provide a labyrinth seal (FIGS. 7 and 8).

Figure 3:
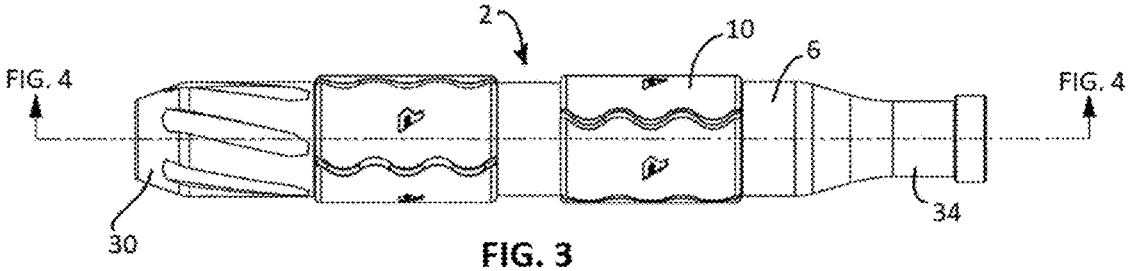
FIG. 3 is a front elevation view of the pad plunger showing FIG. 1.
Figure 4:
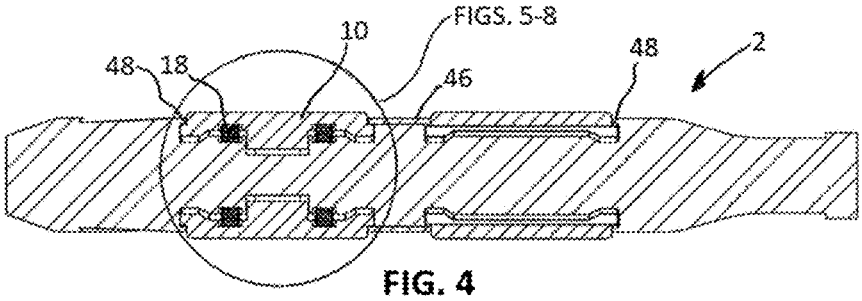
FIG. 4 is a cross-sectional view of FIG. 3.
Figure 5:
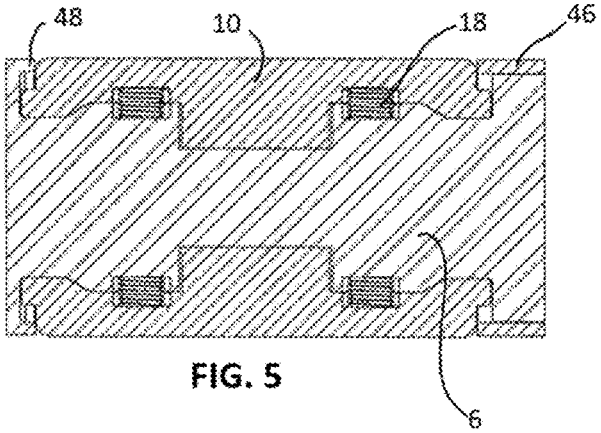
FIG. 5 is a detailed view of FIG. 4, showing pads in a retracted state.
Figure 6:
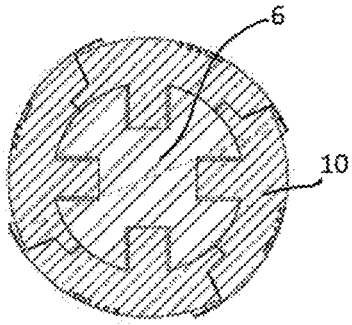
FIG. 6 is a right elevation view of FIG. 5.

A one-piece mandrel 6 that supports the pads 10 is shown in FIG. 3. The mandrel 6 is generally comprised of a downhole end 30 and a fish neck 34 with at least one circumferential recesses 14 positioned therebetween. The downhole end 30 may employ a plurality of angled channels 32 that cause the plunger 2 to rotate as it falls through the production tubing string. The mandrel employs the plurality of slots 26 that receive corresponding posts 22 of the pads, which maintains engagement with the pads 10 while allowing radial movement inward and outward relative to the longitudinal axis of the mandrel 6. The mandrel also employs a plurality of recesses 38 that receive the springs. In one embodiment, the mandrel supports eight pads comprised of four-pad subassemblies. A ring 42 that receives a band 46 may be provided between the four-pad subassemblies to secure adjacent ends of the plungers and, thereby, limit their radial movement. As shown in FIGS. 4 and 5, for example, the band 46 is slightly wider than the ring 42, wherein portions of the band 46 extend over the circumferential recesses 14. Accordingly, pad movement away from the mandrel is limited by engagement of pad ends with a portion of the band 46 that extends over the circumferential recesses 14. The mandrel may also employ fingers 48 that cooperate with the band 46 to limit pad travel.

Figure 10:
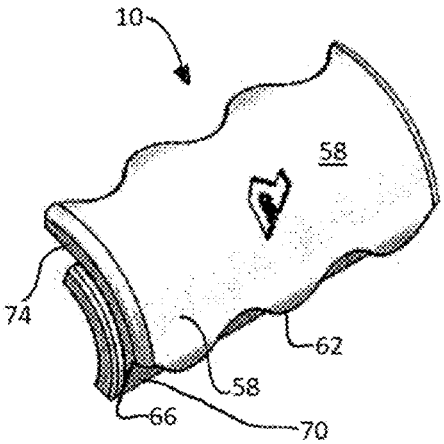
FIG. 10 is a front perspective view of a pad employed by the embodiment shown in FIG. 1.
Figure 11:
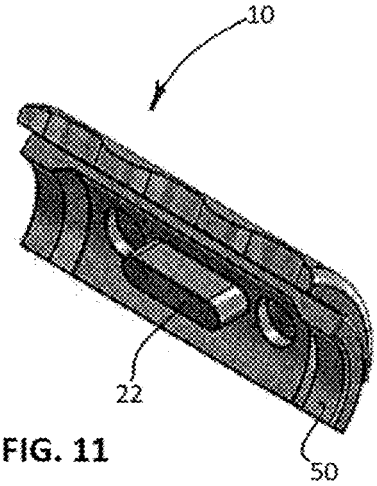
FIG. 11 is a rear perspective view of the pad shown in FIG. 10.
Figure 12:
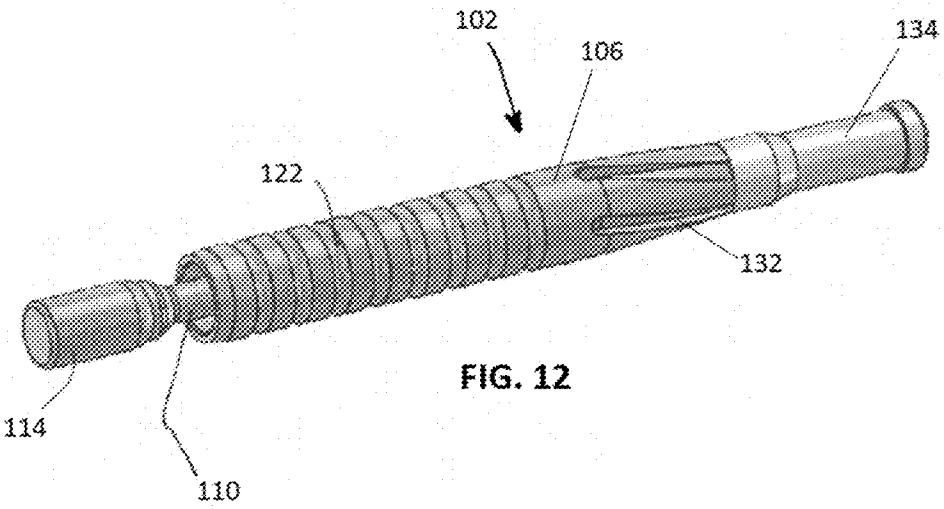
FIG. 12 is a perspective view of a shifting rod plunger of one embodiment of the present invention in a descent configuration.
Figure 13:
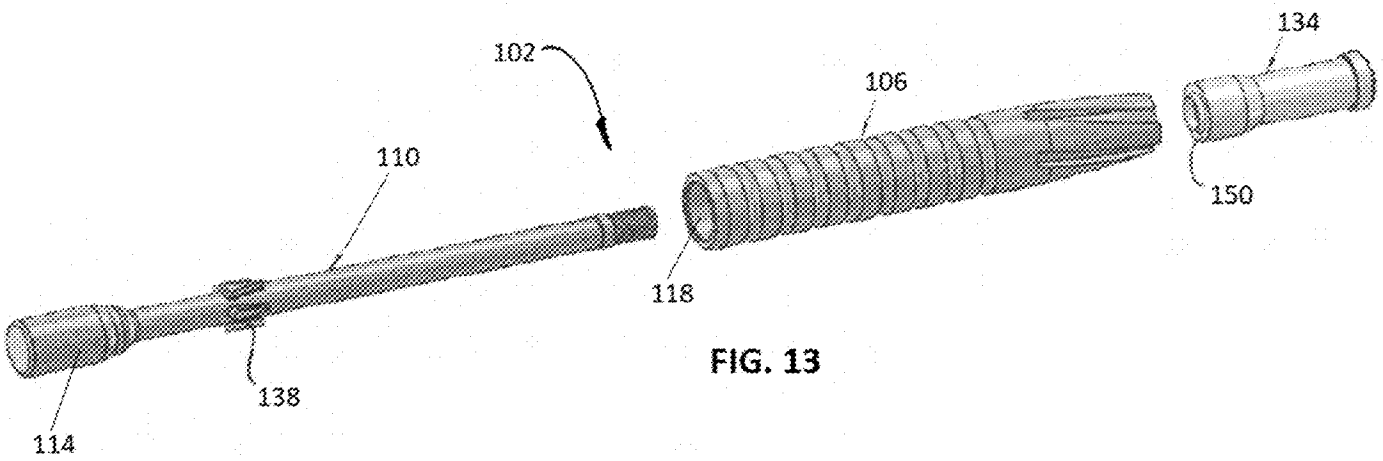
FIG. 13 is a perspective view of the shifting rod plunger of FIG. 12 in an assent configuration.
Figure 14:
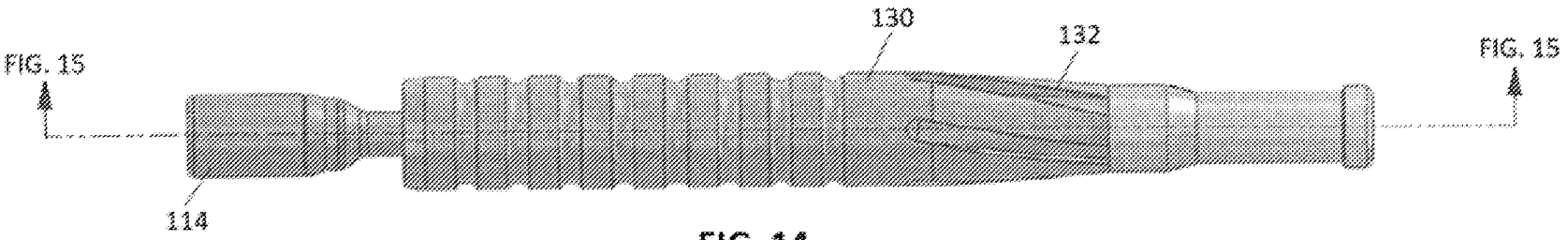
FIG. 14 is a front elevation view of FIG. 12.

FIGS. 10 and 11 show a pad of one embodiment of the present invention that employs an inner portion 50 associated with the post 22 and an outer portion 54 having an outer surface 58 that is configured to contact the production tubing string. In this embodiment, a lateral edge 62 of the outer portion and a lateral edge 66 of inner portion are offset, which provides a ledge 70 that receives an overhang 74 of an adjacent pad, which helps operatively interconnected adjacent pads while allowing them to move radially from the mandrel. The lateral edges 62 of the outer portion may have a sinusoidal profile that cooperates with a corresponding profile of an adjacent pad to create a serpentine flow path, which slows or prevents gas migration around the pad plunger as it ascends the production tubing string. Further, in some embodiments of the present invention, the outer surface 58 of the pads possess narrow-angle slots that reduce pad friction as the plunger travels through the well tubing when small amounts of sand or other debris are encountered.

FIGS. 12-23 show a shifting rod plunger 102 of one embodiment of the present invention generally comprised of a body 106 that slidingly receives a rod 110. The body 106 is maintained on the rod by a head 114 and a fish neck 134. The body 106 is a generally cylindrical member with a bore 118 therethrough. The body may also employ a plurality of channels 132 on an upper end 130 that imparts rotation of the shifting rod plunger 102 as it rises through the production tubing string. As commonly found in the art, the body 106 may employ a plurality of radially extending ridges 122 on its outer periphery to facilitate movement through the production tubing string. The body 106 may also include at least one orifice 126 that connects the outer surface of the body to the bore 118.

The rod has an enlarged head 114 located on the downhole end of the shifting rod plunger 102 and a threaded end configured to receive the fish neck 134. The rod 110 also employs a plurality of radially extending protrusions 138 configured to operatively engage the inner surface 142 of the bore 118. The protrusions 138 may be teardrop-shaped. This feature of the invention generally maintains the spacing of the rod relative to the inner surface 142 of the bore 118, which is important as the body moves relative to the rod when the head impacts a bumper spring assembly and the lubricator valve.

Figure 15:
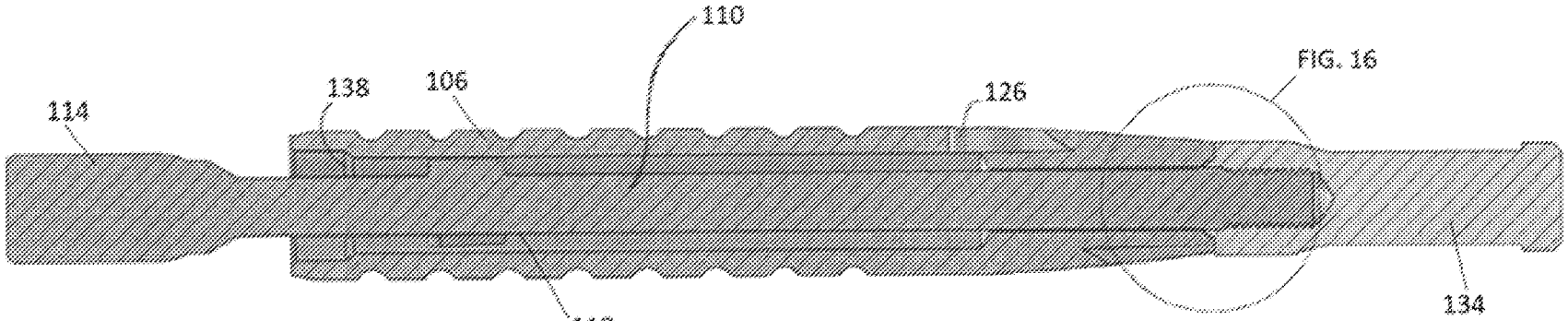
FIG. 15 is a cross-sectional view of FIG. 14.

In operation, the protrusions facilitate the smooth movement of the body 106 from a descent configuration shown in FIG. 15 to an ascent configuration wherein the body 106 unseats from the fish neck as the head 114 impacts the bumper spring assembly. Upon impact, the body will slide downwardly and engage the head, thereby blocking fluid access to the bore, which allows pressure to build up behind the plunger prior to the ascent stage described above. Ultimately, the shifting rod plunger will impact the lubricator valve, thereby unseating the body from the head and again engaging the upper end 130 of the body 106 with the fish neck 134. As described above, the shifting rod plunger will be released into the production tubing string after a predetermined condition occurs. As the floating rod plunger falls, fluids found in the production tubing string are received within the annulus between the rod 110 in the inner surface 142 of the body and expelled through one or more orifices 126.

Figure 16:
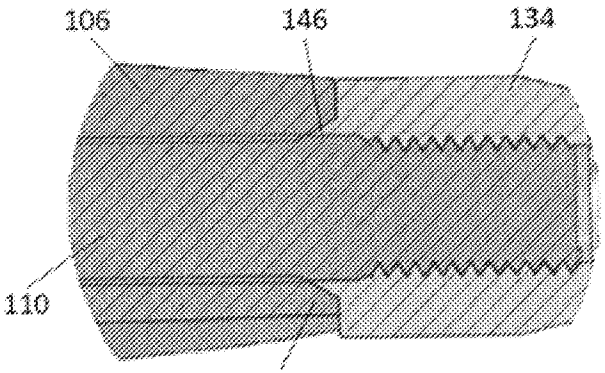
FIG. 16 is a detailed view of FIG. 15.
Figure 17:
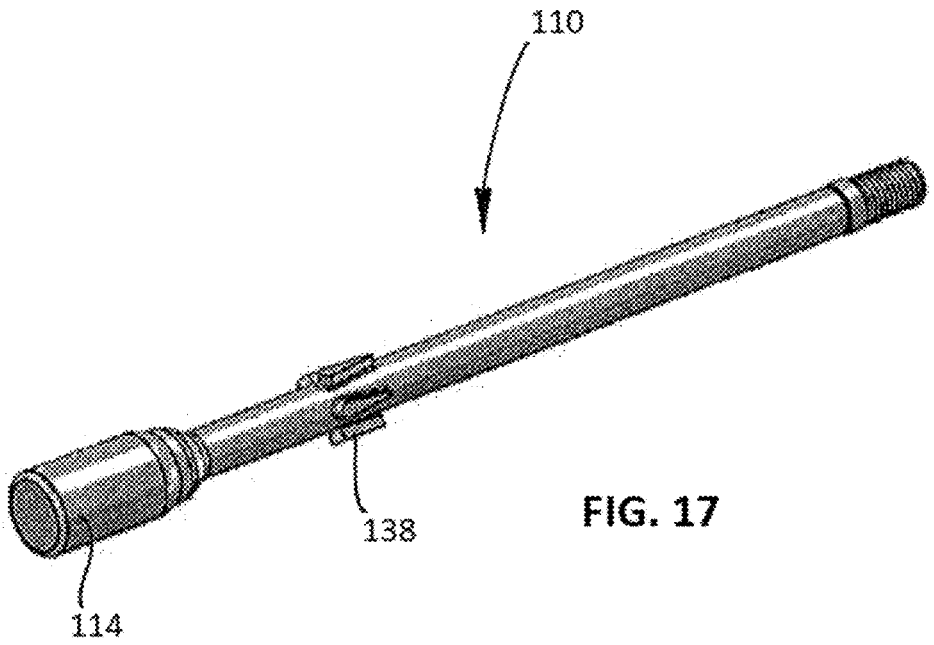
FIG. 17 is a perspective view of a rod employed by the shifting rod plunger shown in FIG. 12.
Figure 18:
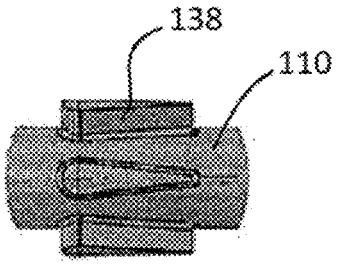
FIG. 18 is a detailed view of FIG. 17.
Figure 19:
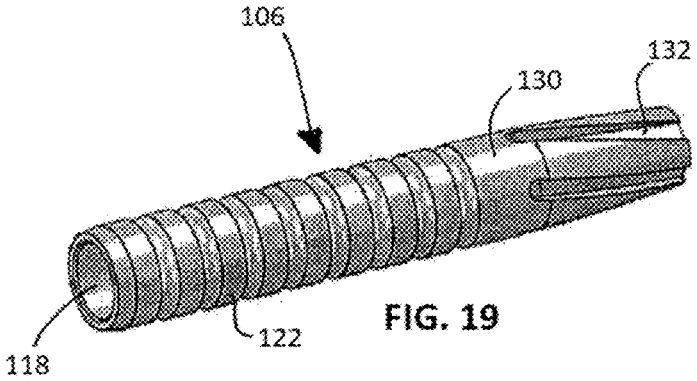
FIG. 19 is a perspective view of a sliding body employed by the shifting rod plunger shown in FIG. 12.
Figure 21:
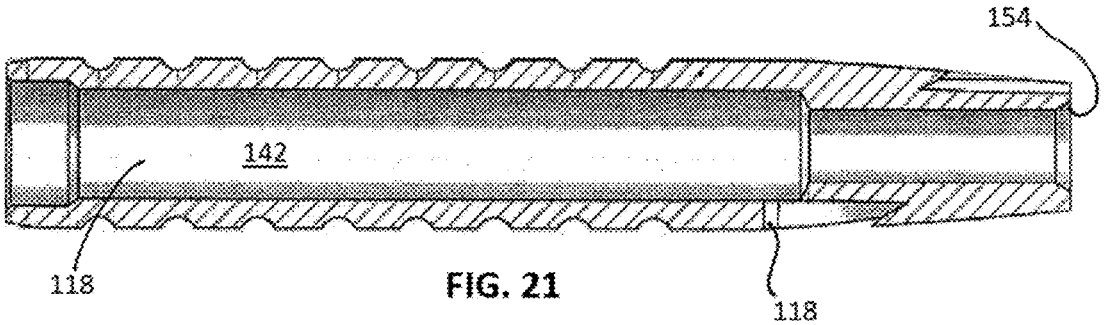
FIG. 21 is a cross-sectional view of FIG. 20.
Figure 20:
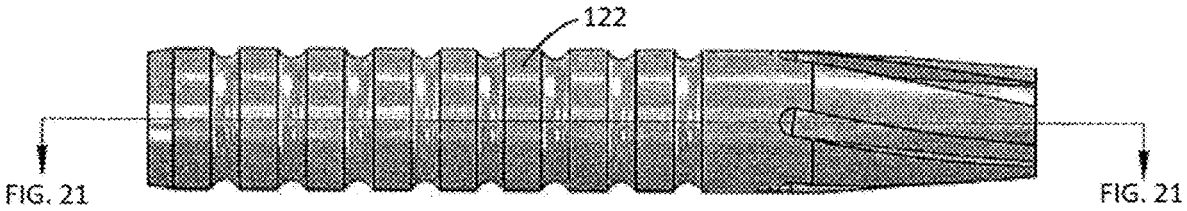
FIG. 20 is a front elevation view of the sliding body.
Figure 22:
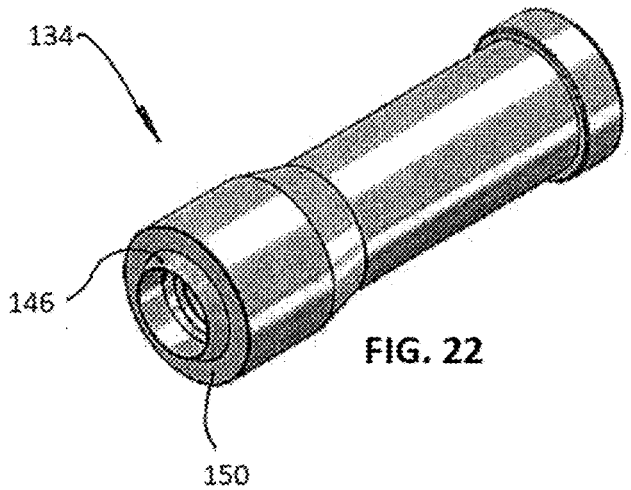
FIG. 22 is a perspective view of a fish neck end employed by the shifting rod plunger shown in FIG. 12.
Figure 23:
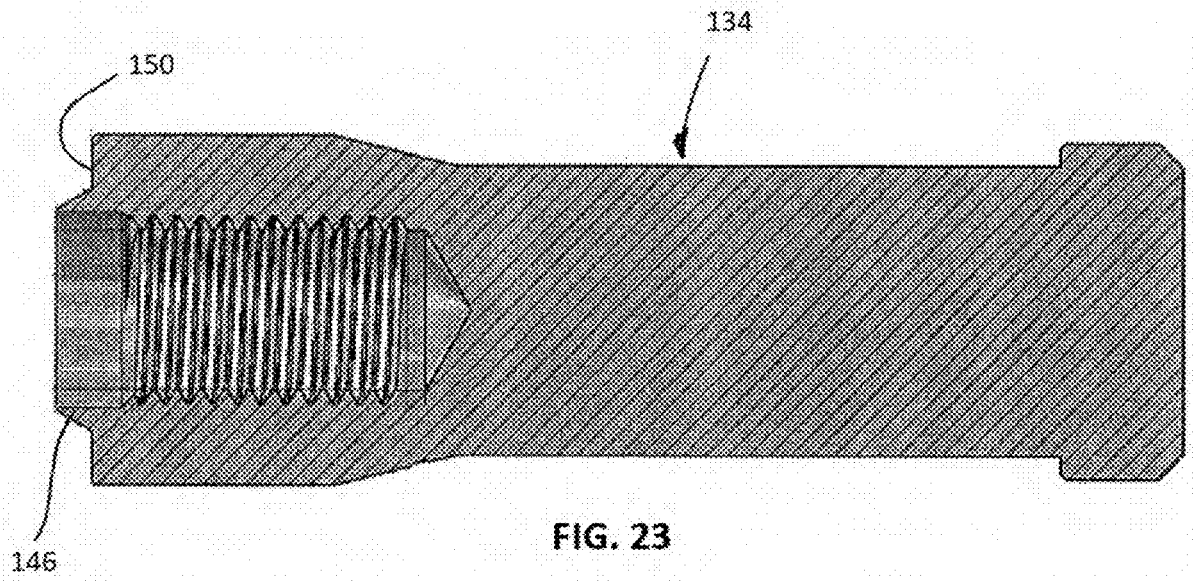
FIG. 23 is a cross-sectional view of FIG. 22.
Figure 24:
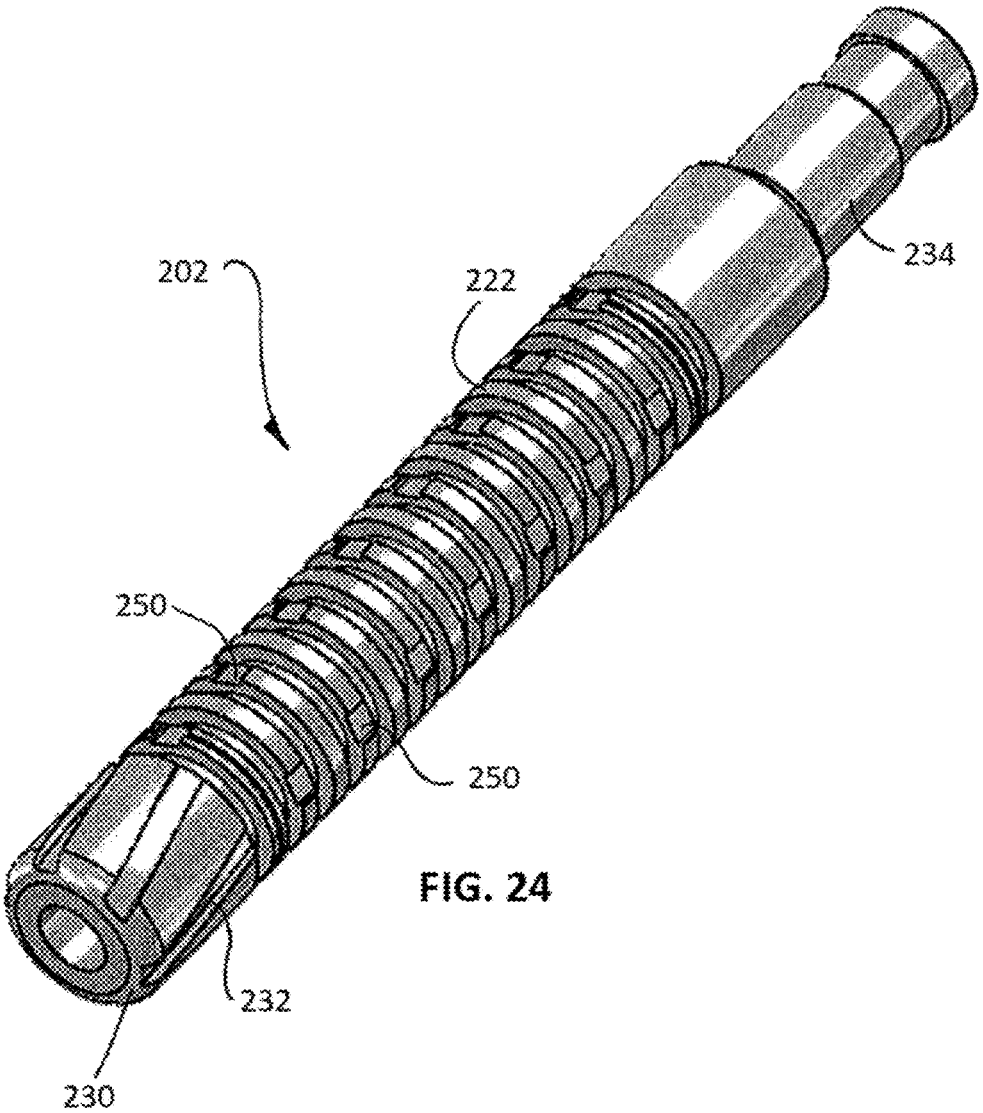
FIG. 24 is a perspective view of a sand plunger of one embodiment of the present invention.
Figure 25:
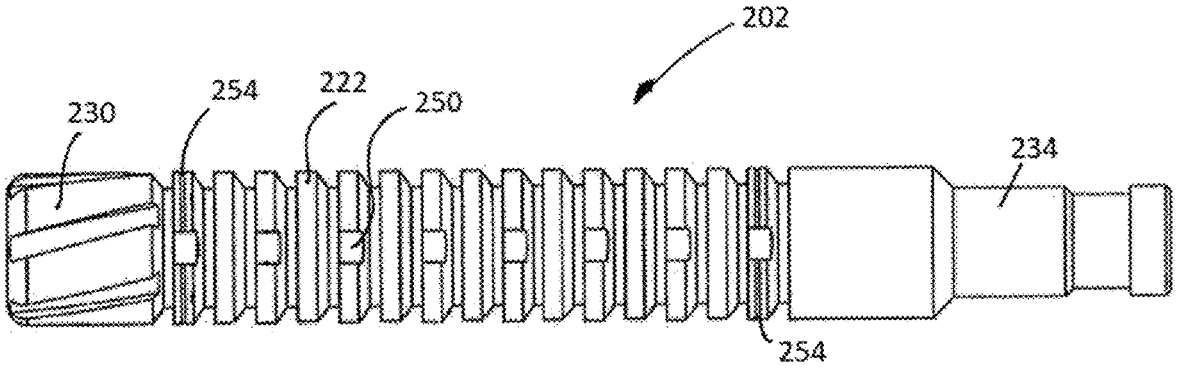
FIG. 25 is a front elevation view of the sand plunger shown in FIG. 24.
Figure 26:
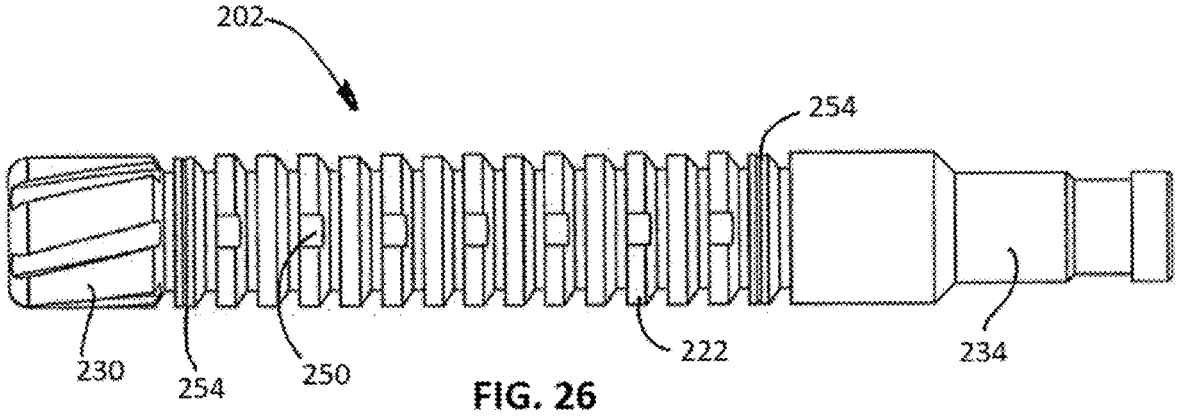
FIG. 26 is a top plan view of the sand plunger shown in FIG. 24.
Figure 27:
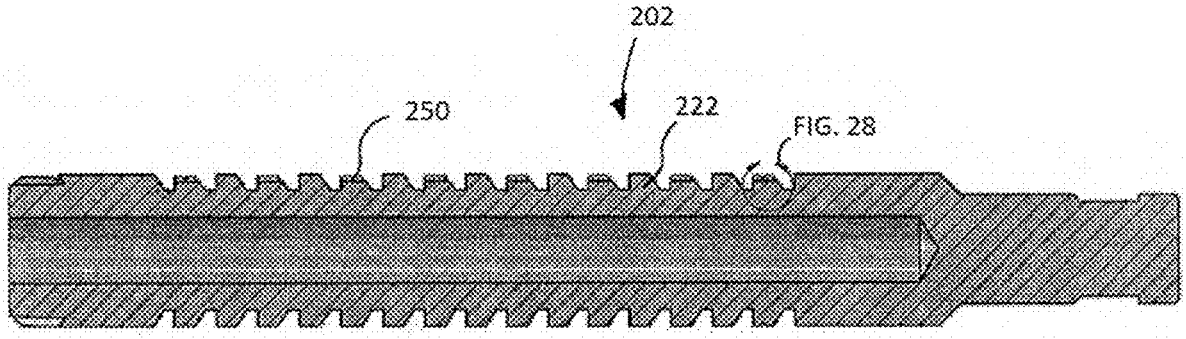
FIG. 27 is a cross-sectional view of FIG. 26.

FIGS. 16, 22, and 23 show the fish neck 134 of one embodiment of the present invention how and it interacts with a body 106. One of ordinary skill in the art will appreciate plunger interaction with lubricator valve at the surface, which unseats the body from the head and forces the body against the fish neck, may be a violent event that often damages the rod. Accordingly, some embodiments of the present invention employ a fish neck 134 with a conical riser 146 extending from its inner face 150. Again, the rod has a threaded end, which is received by the fish neck 134, with a conical, unthreaded riser 146 designed to fit inside a corresponding counterbore 154 of the body 106. Furthermore, the interconnection between the rod and the fish neck may be defined by a circumferential zone wherein a threaded connection is not provided. A tight tolerance between these components eliminates or reduces bending stresses between a threaded connection in the rod. Many shifting rod plungers do not incorporate such features and, thus, the rods of many prior art devices are off-center at the time of impact on the bumper spring assembly or the lubricator spring of wellhead at the completion of the plunger's ascent. By stabilizing the rod during contact with the lubricator valve or bumper spring assembly, rod whipping is reduced or prevented and, thus, instances of rod breakage are reduced.

FIGS. 24-28 show a sand plunger 202 of one embodiment of the present invention that eliminates a continuous bore and/or intersecting radial holes for bleeding gas pressure found in some sand plungers of the prior art. The sand plunger 202 of one embodiment of the present invention is generally comprised of a cylindrical member with a downhole end 230, which may have a plurality of channels 232, and a fish neck 234. A plurality of shallow slots 250 are formed at the crest of alternating ridges 222 that define at least a portion of the plunger's outer surface. In one embodiment, the slots 250 occur in pairs at 0° and 180° on alternating ridges. The slots 250 of the intervening ridges are found at 90° and 270°. Thus, adjacent ridges do not have the same slot configuration. In one embodiment, the slots penetrate about 0.090 inches into the ridges and are about 0.400 inches wide. However, the dimensions, location, and the number of slots vary depending on the desired performance. The slots reduce descent times and promote aeration of the fluid column above the plunger during ascent.

Figure 28:
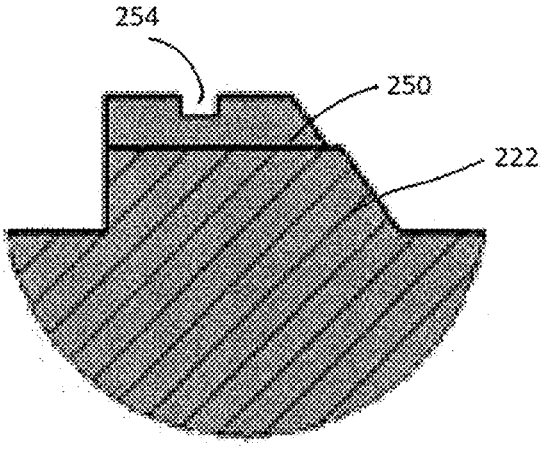
FIG. 28 is a detailed view of FIG. 27.
Figure 29:
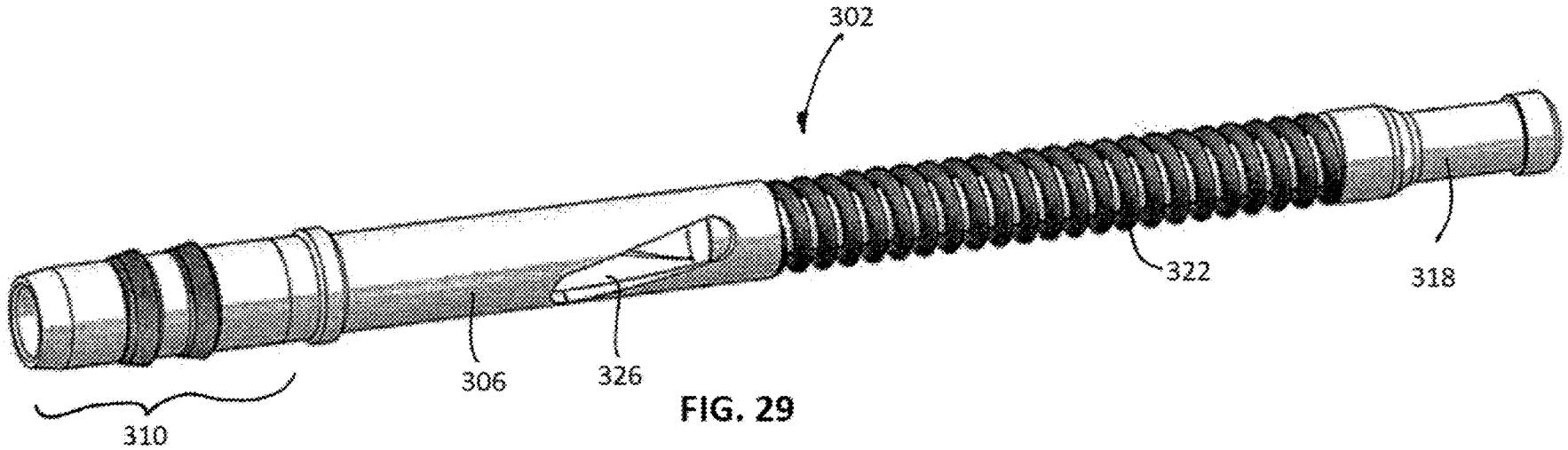
FIG. 29 is a perspective view of a bumper spring assembly of one embodiment of the present invention.
Figure 30:
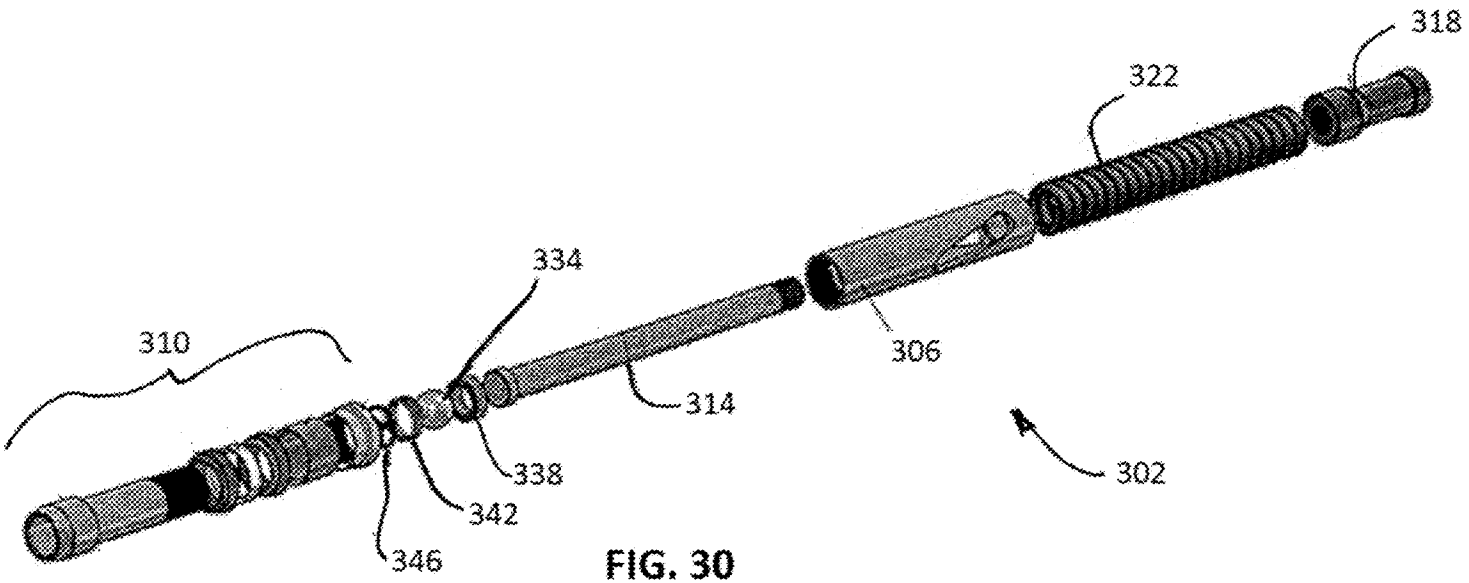
FIG. 30 is an exploded perspective view of the bumper spring assembly shown in FIG. 29.

FIG. 28 shows a circumferential groove 254 located on the ridges immediately adjacent to the downhole end 230 and the fish neck 234. These grooves enhance self-cleaning and improve the turbulent seal provided by the intervening ridges. The groove 254 of one embodiment is about 0.025 inches deep and about 0.050 wide.

FIG. 29-38 show a bumper spring assembly 302 of one embodiment of the present invention that comprises a cage 306 interconnected to a nipple subassembly 310. As those of ordinary skill in the art will appreciate, the nipple of assembly 310 is configured to engage with the inner surface of the production tubing string at the end thereof. The bumper spring assembly has an outer diameter less than that of the production tubing string and, thus, will be exposed to fluids entering the production tubing string through the perforations provided. A rod 314 is operatively received by the cage on one end and includes a fish neck 318 at an opposite end. Impact forces exerted on the fish neck 318 are reacted by a spring 322 positioned about the rod 314 with one end abutting the fish neck 318 and an opposite end abutting an upper surface of the cage 306. The cage has at least one opening 326 that allows pressure exerted by fluid within the production tubing string and surrounding at least a portion of the bumper spring assembly to communicate with the internal volume of the cage.

Figure 31:
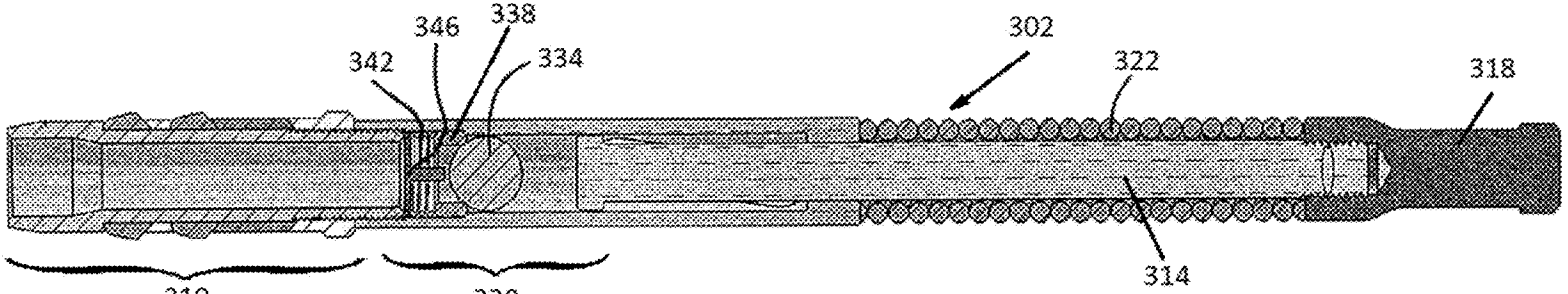
FIG. 31 is a cross-sectional view of the bumper spring assembly of FIG. 29 in an open configuration.
Figure 32:
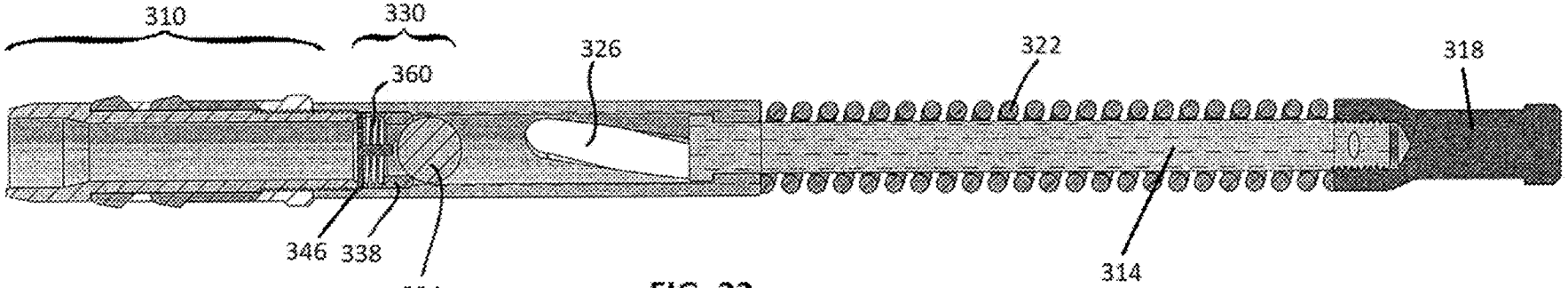
FIG. 32 is a cross-sectional view of the bumper spring assembly of FIG. 29 in a closed configuration.

Referring now in particular to FIGS. 31 and 32, the internal componentry of the bumper spring assembly of this embodiment of the present invention is shown. More specifically, FIG. 31 shows the bumper spring assembly immediately upon impact by a plunger. FIG. 32 shows the bumper spring assembly after plunger impact and while supporting a plunger (not shown) on its fish neck 18 or during the plunger's ascent, wherein the spring 322 is extended and the majority of the cage openings 326 are exposed to the annulus between the bumper spring assembly and the inner surface of the production tubing string. Pressure will build within the production tubing string and the annulus between the production tubing string and the well casing during well shut in. Accordingly, fluids within the production tubing string and the annulus will enter the bumper spring assembly through the cage openings 26 and will be prevented from returning to the formation through the nipple subassembly 310 by a stop the valve 330.

The standing valve is a one-way check valve comprised of a ball 334, which can move freely within the cage 306, and a ball seat 338. When pressure about the bumper spring assembly 302 and, thus, the cage reaches a predetermined level, the ball is urged downwardly to contact the ball seat 338, thereby preventing the return of liquid into the formation, which maintains a liquid level necessary to create an acceptable liquid slug for the plunger. To address instances of overpressure, a pressure relief system is provided.

Figure 35:
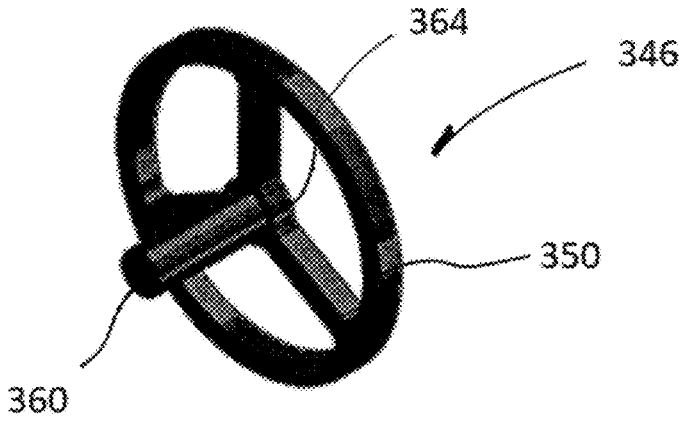
FIG. 35 is a perspective view of a spring seat used in the bumper spring assembly of FIG. 29.
Figure 36:
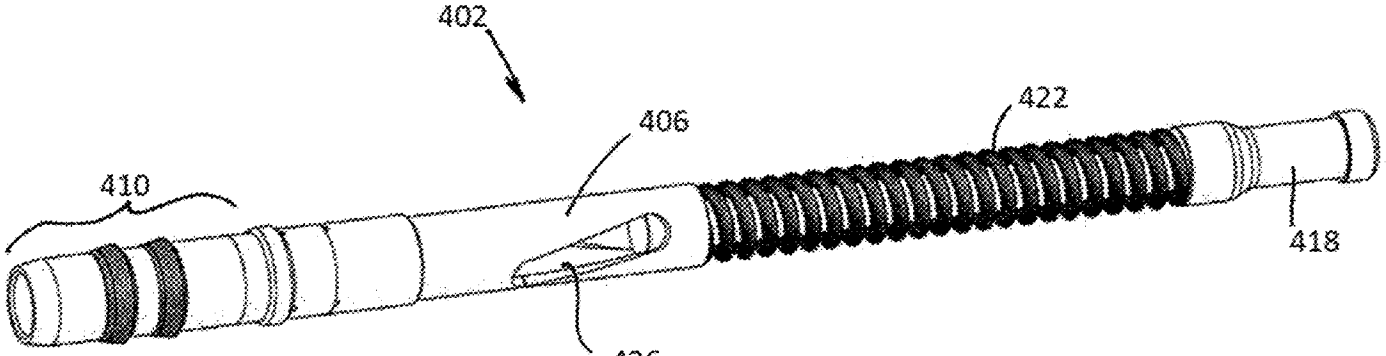
FIG. 36 is a perspective view of a bumper spring assembly of an alternate embodiment of the present invention.
Figure 37:
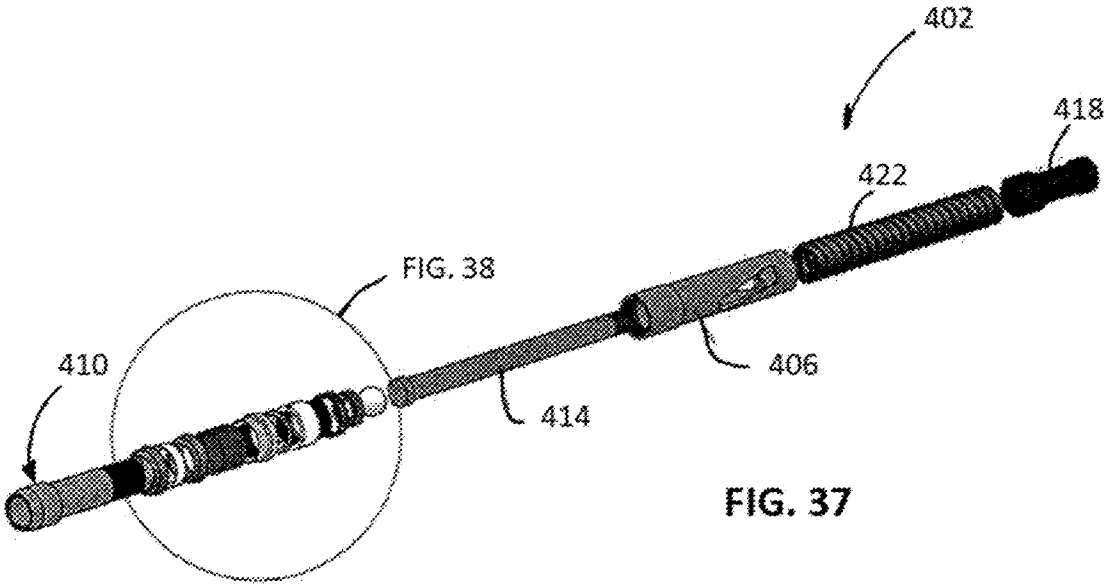
FIG. 37 is an exploded perspective view of the bumper spring assembly shown in FIG. 36.

More specifically, the pressure relief system of one embodiment of the present invention comprises a spring 342 positioned between the ball seat 338 and a spring seat 346. The spring seat, as shown in FIG. 35, is generally comprised of a disk 350 with a plurality of fluid openings 354 therethrough. In addition, a pin 360 extends from the center hub 364 of the disk 350. In operation, when the pressure within the cage increases beyond a predetermined level, which is higher than the degree of pressure needed to seat the ball 334 into the ball seat 338, the ball 334 and the ball seat 338 will be urged downwardly against the force of the spring 342. Eventually, however, the ball 334 will contact the pin 360, thereby unseating the ball 334 from the ball seat 338 which allows liquid to pass into the formation through the nipple subassembly 310. Once pressure is relieved, the spring 342 will relax and push the ball seat 338 upwardly in contact with the ball 334, which again closes the standing valve 330 and prevents additional fluid from returning to the formation. Accordingly, the relief pressure can be changed by altering the length of the pin, wherein spring stiffness or other design changes do not need to be made to the bumper spring assembly.

Figure 33:
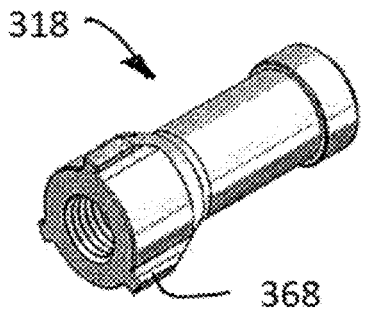
FIG. 33 is a perspective view of a fish neck end used in a bumper spring assembly of some embodiments of the present invention.
Figure 34:
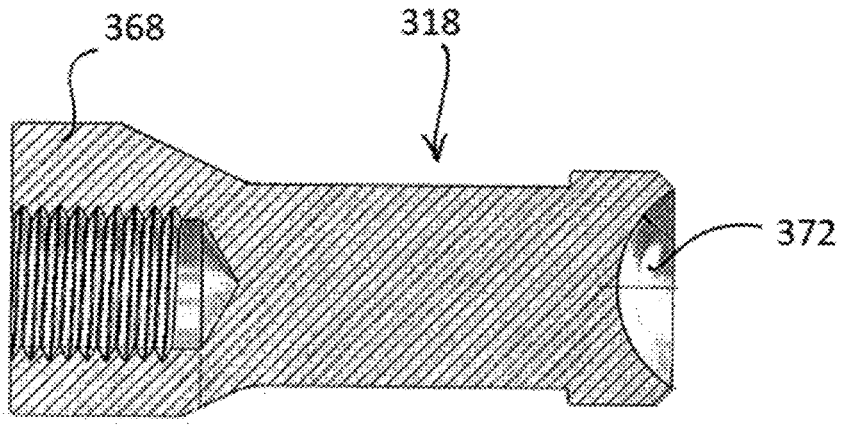
FIG. 34 is a cross-sectional view of FIG. 33.

FIGS. 33 and 34 show a fish neck 318 employed by some embodiments of the present invention. To help ensure the fish neck is generally centered within the production tubing string, a plurality of protrusions 368 are provided. The protrusions 368 extend radially from a portion of the fish neck 318 and have an outer extent designed to selectively contact the production tubing string's inner surface, which helps direct the majority of the impact force through the fish neck and into the spring. The fish neck of some embodiments of the present invention also includes a spherical face 372 configured to efficiently capture balls employed by some plunger configurations.

Figure 38:
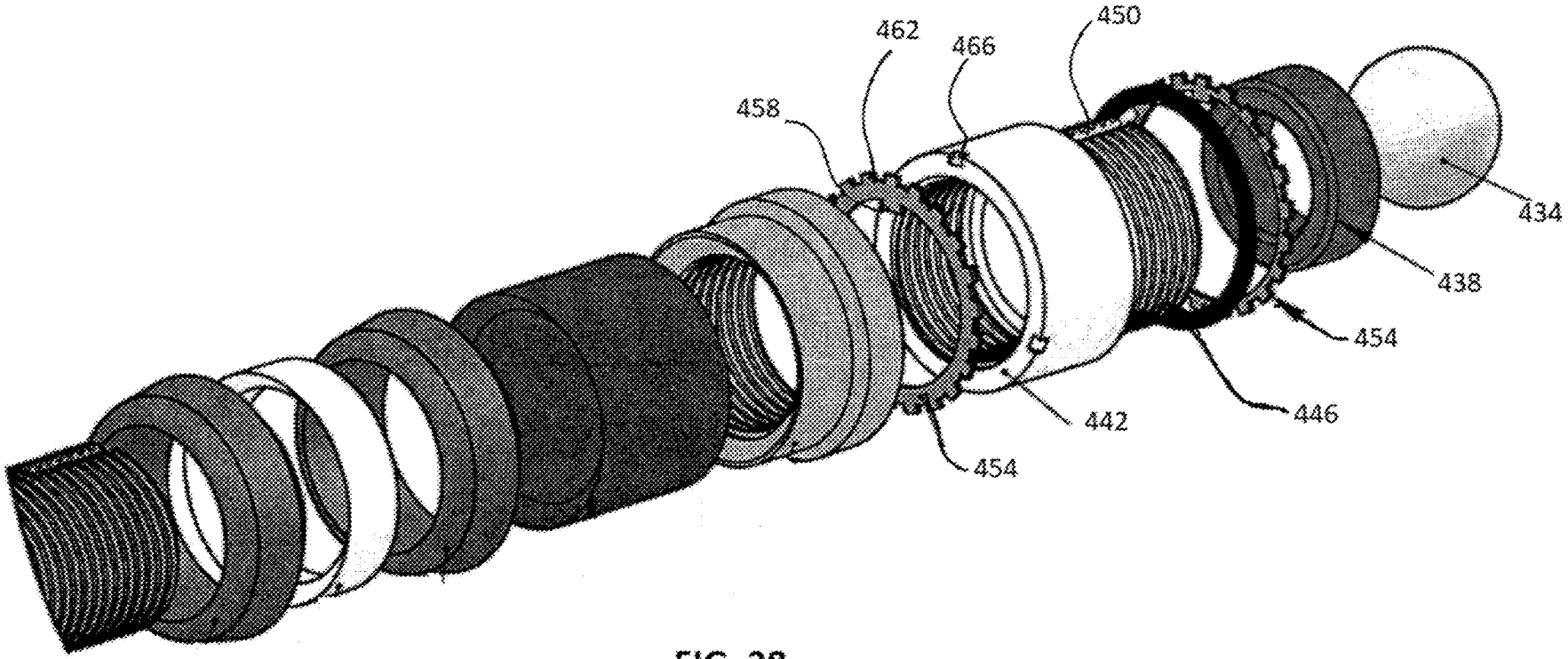
FIG. 38 is a detailed view of FIG. 37.
Figure 39:
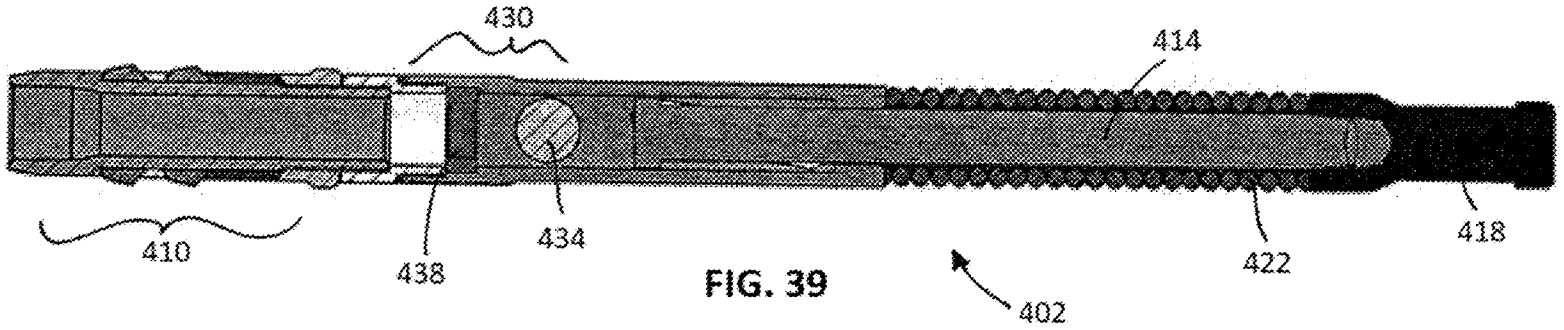
FIG. 39 is a cross-sectional view of the bumper spring assembly of FIG. 36 in an open configuration.
Figure 40:
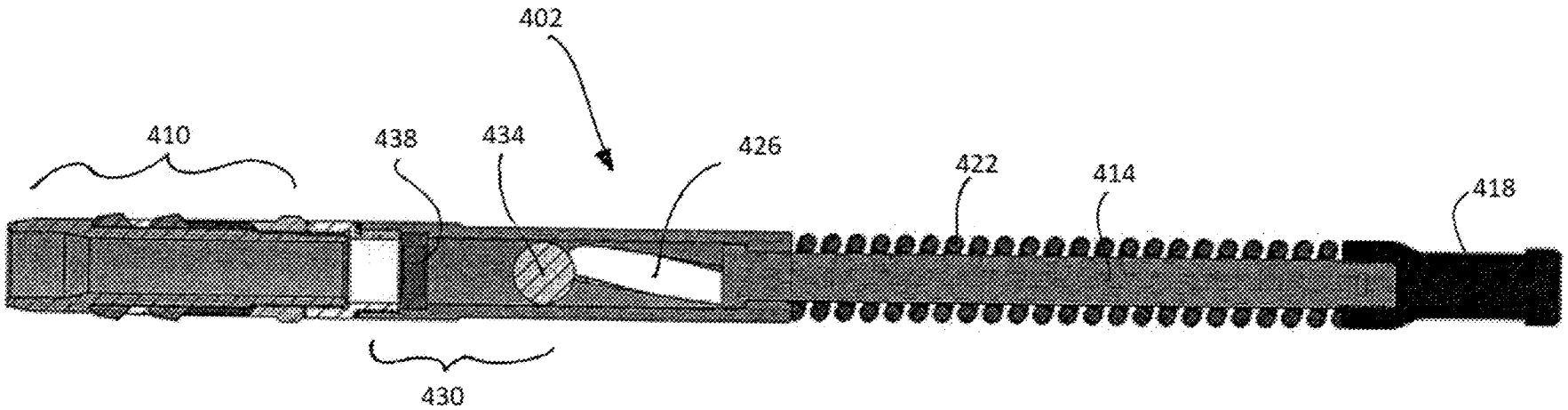
FIG. 40 is a cross-sectional view of the bumper spring assembly of FIG. 36 in a closed configuration.

FIGS. 36-40 show a bumper spring assembly 402 of another embodiment of the present invention that addresses the issues associated with interconnecting component parts. Similar to the embodiment described above, this bumper spring assembly 402 is generally comprised of a cage 406 interconnected to a nipple subassembly 410 and operatively interconnected to a rod 414. In addition, the rod 414 includes a fish neck 418 at one end and accommodates a spring 422. Accordingly, as shown in FIGS. 39 and 40 the functioning of this bumper spring assembly is similar to that of current assemblies that employ a ball 434 and ball seat 438 that acts as the standing valve 430.

The primary difference of this embodiment is the method by which component parts are secured. FIG. 38 illustrates the method employed by some embodiments of the present invention. Here, an adapter 442 is shown that has a threaded portion 446 with the slot 450 cut into the threads and extending parallel to the longitudinal axis of the adapter 442. The threaded portion 446 is received within a collar, for example, with a locking washer 454 positioned therebetween. The locking washer comprises a locating tab 458 extending from its inner diameter and a plurality of locking tabs 462. In operation, the locating tabs 458 are received by the slots 450 and the locking tabs 462 are deformed into corresponding locking recesses 466 of an adjoining component which prevents relative rotation of the two interconnected components. If disassembly of the components is desired, the locking tab 462 is simply bent out of the locking recess 466 which will allow the threaded components to be separated.

Exemplary characteristics of embodiments of the present invention have been described. However, to avoid unnecessarily obscuring embodiments of the present invention, the preceding description may omit several known apparatus, methods, systems, structures, and/or devices one of ordinary skill in the art would understand are commonly included with the embodiments of the present invention. Such omissions are not to be construed as a limitation of the scope of the claimed invention. Specific details are set forth to provide an understanding of some embodiments of the present invention. It should, however, be appreciated that embodiments of the present invention may be practiced in a variety of ways beyond the specific detail set forth herein.

Modifications and alterations of the various embodiments of the present invention described herein will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. That is, the embodiments of the invention described herein are capable of being practiced or of being carried out in various ways. The scope of the various embodiments described herein is indicated by the following claims rather than by the foregoing description. And all changes which come within the meaning and range of equivalency of the claims are to be embraced within their scope. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The foregoing disclosure is not intended to limit the invention to the form or forms disclosed herein. In the foregoing Detailed Description, for example, various features of the invention are grouped together in one or more embodiments for the purpose of streamlining the disclosure. This method of disclosure is not to be interpreted as reflecting an intention that the claimed inventions require more features than expressly recited. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention. Further, the embodiments of the present invention described herein include components, methods, processes, systems, and/or apparatus substantially as depicted and described herein, including various sub-combinations and subsets thereof. Accordingly, one of skill in the art will appreciate that would be possible to provide for some features of the embodiments of the present invention without providing others. Stated differently, any one or more of the aspects, features, elements, means, or embodiments as disclosed herein may be combined with any one or more other aspects, features, elements, means, or embodiments as disclosed herein.

What is claimed is:

1. A plunger of an artificial lift system, comprising:

a mandrel having a downhole end with a plurality of angled channels and an upper end spaced from the downhole end;

a first circumferential recess adjacent to the downhole end having first radial slots evenly spaced in four locations about a circumference of the first circumferential recess, the first slots having an elongate profile generally parallel to a longitudinal axis of the mandrel, first springs integrated into the mandrel adjacent to a downhole end of each first slot, and second springs integrated into the mandrel adjacent to an upper end of each first slot;

a plurality of first pads having an outer arcuate portion and an inner arcuate portion for selective positioning adjacent to and away from an outer surface of the first circumferential recess, wherein the inner arcuate portion includes a post selectively received within the first radial slots, the outer arcuate portion having lateral edges of a sinusoidal shape that generally correspond with the longitudinal axis of the mandrel, the inner arcuate portion having lateral edges that generally correspond with the longitudinal axis of the mandrel, wherein the lateral edges of the outer arcuate portion and the inner arcuate portion are offset to define a ledge and an overhang, wherein an upper surface of the ledge is configured to selectively engage a lower surface of the overhang of an adjacent first pad of the plurality thereof to form a substantially continuous seal;

a second circumferential recess adjacent to the upper end having second radial slots evenly spaced in four locations about a circumference of the second circumferential recess, the second slots having an elongate profile generally parallel to the longitudinal axis of the mandrel, third springs integrated into the mandrel adjacent to a downhole end of each second slot, and fourth springs integrated into the mandrel adjacent to an upper end of each second slot;

a plurality of second pads having an outer arcuate portion and an inner arcuate portion for selective positioning adjacent to and away from an outer surface of the second circumferential recess, wherein the inner arcuate portion includes a post selectively received within the second radial slots, the outer arcuate portion having lateral edges of a sinusoidal shape that generally correspond with the longitudinal axis of the mandrel, the inner arcuate portion having lateral edges that generally correspond with the longitudinal axis of the mandrel, wherein the lateral edges of the outer arcuate portion and the inner arcuate portion are offset to define a ledge and an overhang, wherein an upper surface of the ledge is configured to selectively engage a lower surface of the overhang of an adjacent second pad of the plurality thereof to form a substantially continuous seal;

a ring of a first length positioned between the first circumferential recess and the second circumferential recess, the ring having an outer extent greater than that of the first circumferential recess and the second circumferential recess;

a band positioned about the ring, the band having a second length greater than that of first length of the ring, wherein a first portion of the ring extends over a portion of the first circumferential recess and a second portion of the ring extends over a portion of the second circumferential recess;

wherein the first pads have a first position of use adjacent to the outer surface of the first circumferential recess and a second position of use urged away from the outer surface of the first circumferential recess by the first and second springs, and wherein the first pads are prevented from expansion past a predetermined degree by the first portion of the ring; and wherein the second pads have a first position of use adjacent to the outer surface of the second circumferential recess and a second position of use urged away from the outer surface of the second circumferential recess by the third and fourth springs, and wherein the second pads are prevented from expansion past a predetermined degree by the second portion of the ring.

2. The plunger of claim 1, wherein the first slots are located along the first circumferential recess at about 0°, 90°, 180°, and 270°, and wherein the second slots are located along the second circumferential recess at about 45°, 135°, 225°, and 315°.

3. The plunger of claim 1, wherein the post extending from the inner surface of the first pads and the second pads have an elongate profile that corresponds with the shape of the first slot and second slot, respectively.

4. The plunger of claim 1, wherein the ledges and overhangs of adjacent first pads and second pads are engaged in the when the first pads and second pads are in the first position of use and the second position of use.

5. An artificial lift system, comprising:

a plunger adapted to be positioned within a production tubing string; and a bumper spring assembly, comprising:

a hollow cage having a first end, a second end, and at least one opening extending into an inner volume of the cage;

a rod having a first end and a second end configured to move with the cage;

an end piece interconnected to the first end of the rod;

a first spring positioned about the rod, the first spring abutting the end piece and the first end of the cage;

a nipple subassembly interconnected to the second end of the cage and adapted to engage an inner surface of a production tubing string; and a standing valve, comprising:

a spring seat positioned above the nipple subassembly and within the cage, the spring seat comprised of a disk with at least one fluid opening and a protrusion extending from the disk, a second spring resting on the spring seat, a ball seat resting on the second spring, a ball positioned within the cage and configured to selectively engage the ball seat, wherein the ball engages the ball seat to close the standing valve when the inner volume of the cage is exposed to a first pressure, and wherein the ball disengages from the ball seat when pressure within the cage increases to a second pressure that urges the ball and ball seat against the second spring to a point where an end of the protrusion contacts the ball, thereby moving the ball out of engagement with the ball seat, and wherein the plunger comprises a mandrel having a downhole end with a plurality of angled channels and an upper end spaced from the downhole end;

a first circumferential recess adjacent to the downhole end having first radial slots evenly spaced in four locations about a circumference of the first circumferential recess, the first slots having an elongate profile generally parallel to a longitudinal axis of the mandrel, first springs integrated into the mandrel adjacent to a downhole end of each first slot, and second springs integrated into the mandrel adjacent to an upper end of each first slot;

a plurality of first pads having an outer arcuate portion and an inner arcuate portion for selective positioning adjacent to and away from an outer surface of the first circumferential recess, wherein the inner arcuate portion includes a post selectively received within the first radial slots, the outer arcuate portion having lateral edges of a sinusoidal shape that generally correspond with the longitudinal axis of the mandrel, the inner arcuate portion having lateral edges that generally correspond with the longitudinal axis of the mandrel, wherein the lateral edges of the outer arcuate portion and the inner arcuate portion are offset to define a ledge and an overhang, wherein an upper surface of the ledge is configured to selectively engage a lower surface of the overhang of an adjacent first pad of the plurality thereof to form a substantially continuous seal;

a second circumferential recess adjacent to the upper end having second radial slots evenly spaced in four locations about a circumference of the second circumferential recess, the second slots having an elongate profile generally parallel to the longitudinal axis of the mandrel, third springs integrated into the mandrel adjacent to a downhole end of each second slot, and fourth springs integrated into the mandrel adjacent to an upper end of each second slot;

a plurality of second pads having an outer arcuate portion and an inner arcuate portion for selective positioning adjacent to and away from an outer surface of the second circumferential recess, wherein the inner arcuate portion includes a post selectively received within the second radial slots, the outer arcuate portion having lateral edges of a sinusoidal shape that generally correspond with the longitudinal axis of the mandrel, the inner arcuate portion having lateral edges that generally correspond with the longitudinal axis of the mandrel, wherein the lateral edges of the outer arcuate portion and the inner arcuate portion are offset to define a ledge and an overhang, wherein an upper surface of the ledge is configured to selectively engage a lower surface of the overhang of an adjacent second pad of the plurality thereof to form a substantially continuous seal;

a ring of a first length positioned between the first circumferential recess and the second circumferential recess, the ring having an outer extent greater than that of the first circumferential recess and the second circumferential recess;

a band positioned about the ring, the band having a second length greater than that of first length of the ring, wherein a first portion of the ring extends over a portion of the first circumferential recess and a second portion of the ring extends over a portion of the second circumferential recess;

wherein the first pads have a first position of use adjacent to the outer surface of the first circumferential recess and a second position of use urged away from the outer surface of the first circumferential recess by the first and second springs, and wherein the first pads are prevented from expansion past a predetermined degree by the first portion of the ring; and wherein the second pads have a first position of use adjacent to the outer surface of the second circumferential recess and a second position of use urged away from the outer surface of the second circumferential recess by the third and fourth springs, and wherein the second pads are prevented from expansion past a predetermined degree by the second portion of the ring.

6. The system of claim 5, wherein the plunger comprises:

a body having a bore extending from a first end and a second end thereof, the body having at least one orifice extending from an outer surface of the body into the bore;

a rod configured to fit within the body, the rod having a head at one end and a threaded end spaced from the head, the rod also having a plurality of radially extending protrusions configured to operatively engage an inner surface of the bore;

an end piece engaged to the threaded end of the rod; and wherein the body has a first position of use with the first end of the body is engaged to the end piece, and a second position of use wherein the body is moved towards the head such that the first end of the body is spaced from the end piece and a portion of the head is positioned within the bore adjacent to the second end of the body.

7. The system of claim 5, wherein the plunger has an outer surface with a plurality of outwardly extending ridges, wherein each ridge has at least one longitudinally oriented slot.

8. The system of claim 5, wherein the plunger has an outer surface with a plurality of outwardly extending ridges, wherein at least one ridge has a circumferential groove.

* * * * *